US010195848B2

(12) United States Patent
Nakagawa et al.

(10) Patent No.: US 10,195,848 B2
(45) Date of Patent: Feb. 5, 2019

(54) LIQUID DISCHARGE HEAD AND LIQUID DISCHARGE METHOD

(71) Applicant: CANON KABUSHIKI KAISHA, Tokyo (JP)

(72) Inventors: Yoshiyuki Nakagawa, Kawasaki (JP); Shintaro Kasai, Yokohama (JP); Akiko Saito, Tokyo (JP); Shinji Kishikawa, Tokyo (JP); Takayuki Sekine, Kawasaki (JP); Shuzo Iwanaga, Kawasaki (JP); Takatsugu Moriya, Tokyo (JP); Koichi Ishida, Tokyo (JP); Tatsuya Yamada, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/396,002

(22) Filed: Dec. 30, 2016

(65) Prior Publication Data

US 2017/0197410 A1 Jul. 13, 2017

(30) Foreign Application Priority Data

Jan. 8, 2016 (JP) ..... 2016-002948
Nov. 28, 2016 (JP) ..... 2016-230099

(51) Int. Cl.
*B41J 2/14* (2006.01)
*B41J 2/155* (2006.01)
*B41J 2/18* (2006.01)

(52) U.S. Cl.
CPC ..... *B41J 2/1404* (2013.01); *B41J 2/14024* (2013.01); *B41J 2/14032* (2013.01); *B41J 2/155* (2013.01); *B41J 2/18* (2013.01); *B41J 2002/14169* (2013.01); *B41J 2002/14185* (2013.01); *B41J 2002/14475* (2013.01); *B41J 2202/12* (2013.01); *B41J 2202/20* (2013.01)

(58) Field of Classification Search
CPC .. B41J 2/14016; B41J 2/1404; B41J 2/14032; B41J 2002/14169; B41J 2002/14185; B41J 2/18
See application file for complete search history.

(56) References Cited

U.S. PATENT DOCUMENTS 7,070,262 B2 * 7/2006 Yamamoto ..... B41J 2/1404 347/100
7,712,869 B2 * 5/2010 Silverbrook ..... B41J 2/1404 347/47
2004/0207692 A1 10/2004 Yamamoto
2007/0081030 A1 4/2007 Silverbrook
(Continued)

FOREIGN PATENT DOCUMENTS

JP 2008-290380 * 12/2008 ..... B41J 2/045
JP 2008290380 A 12/2008
(Continued)

*Primary Examiner* — Geoffrey S Mruk
(74) *Attorney, Agent, or Firm* — Canon U.S.A., Inc. I.P. Division

(57) ABSTRACT

A liquid discharge head includes a recording element configured to generate thermal energy and a discharge orifice disposed at a position facing the recording element. A bubble is generated in liquid by the thermal energy, liquid between the bubble and the discharge orifice is discharged from the discharge orifice by the pressure of the generated bubble, and the bubble communicates with the atmosphere on the outside of the discharge orifice.

20 Claims, 35 Drawing Sheets

(56) References Cited

U.S. PATENT DOCUMENTS

| | | | | |
|---|---|---|---|---|
| 2011/0205303 | A1 | 8/2011 | Pan et al. | |
| 2012/0098899 | A1* | 4/2012 | Xie | B41J 2/1404 347/85 |

FOREIGN PATENT DOCUMENTS

| | | | |
|---|---|---|---|
| JP | 2010-240873 | A | 10/2010 |
| JP | 2011-025516 | A | 2/2011 |
| JP | 2013-000914 | A | 1/2013 |

* cited by examiner

LIQUID DISCHARGE HEAD AND LIQUID DISCHARGE METHOD

BACKGROUND OF THE INVENTION

Field of the Invention

The present invention relates a liquid discharge head and a liquid discharge method, and more particularly relates to a configuration near a discharge orifice that discharges liquid.

Description of the Related Art

Droplets discharged from a liquid discharge head such as an inkjet head generally separate into a main droplet and accompanying sub-droplets (hereinafter, also referred to as "satellites") upon being discharged. The main droplet lands at the intended position on the recording medium, but controlling the landing positions of satellites is difficult. Satellites may account for conspicuous deterioration in recording image quality with liquid discharge heads of which high throughput is demanded. Particularly fine satellites do not reach the recording medium, and become floating ink droplets (hereinafter, also referred to as "mist"). Mist may soil the recording apparatus, and this contamination of the recording medium may be transferred to the recording medium and soil the recording medium.

Japanese Patent Laid-Open No. 2008-290380 discloses a method of reducing occurrence of satellites by forming discharge orifices as shapes other than circles, in order to prevent deterioration of image quality due to satellites. U.S. Patent Application Publication No. 2011/0205303 discloses a method where the distance between recording elements and discharge orifices is made shorter to reduce the length of the droplet (hereinafter, also referred to as "tail length"), thereby reducing occurrence of satellites. However, studies made by the Present Inventor have shown that the configurations of Japanese Patent Laid-Open No. 2008-290380 and U.S. Patent Application Publication No. 2011/0205303 do not realize further reduction in the tail length. This has let to recognition of a new problem regarding how difficult it is to control satellites.

It has been found desirable to provide a liquid discharge head and liquid discharge method capable of reducing the tail length of droplets.

SUMMARY OF THE INVENTION

A liquid discharge head according to the present invention includes: a recording element configured to generate thermal energy used to discharge liquid; a pressure chamber having the recording element within; a discharge orifice configured to discharge liquid; and a discharge orifice portion communicating between the discharge orifice and the pressure chamber. A bubble is generated in the pressure chamber by the thermal energy, the generated bubble enters inside the discharge orifice portion, and liquid is discharged from the discharge orifice by the pressure of the bubble. The bubble that has entered inside the discharge orifice portion communicates with the atmosphere on the outside of the discharge orifice.

Further features of the present invention will become apparent from the following description of exemplary embodiments with reference to the attached drawings.

DESCRIPTION OF THE EMBODIMENTS

A liquid discharge head according to application examples and embodiments of the present invention will be described below with reference to the drawings. Although various technically preferable conditions are associated with the application examples and embodiments described below, the present invention is not restricted to the conditions in these application examples and embodiments as long as following the idea of the present invention. Note that the liquid discharge head according to the present invention that discharges liquid such as ink and the like, and liquid discharge apparatus to which the liquid discharge head is mounted, are applicable to apparatuses such as printers, photocopiers, facsimile devices having communication systems, word processors having printer units, and so forth, and further to industrial recording apparatuses combined in a complex manner with various types of processing devices. For example, the present invention can be used in fabricating biochips, printing electronic circuits, fabricating semiconductor substrates, and other such usages.

In the following description of embodiments of the present invention made with reference to the drawings, the description made below does not restrict the scope of the present invention. Although the application examples and embodiments relate to an inkjet recording apparatus (or simply "recording apparatus") of a form where a liquid such as ink or the like is circulated between an ink tank and liquid discharge head, other forms may be used as well. For example, a form may be employed where, instead of circulating ink, two ink tanks are provided, one at the upstream side of the liquid discharge head and the other on the downstream side, and ink within the pressure chamber is caused to flow by running ink from one ink tank to the other.

Also, the application examples and embodiments relate to a so-called line head that has a length corresponding to the width of the recording medium, but the present invention can also be a so-called serial liquid discharge head (page-wide) that records while scanning over the recording medium. An example of a serial liquid discharge head is a configuration that has one recording element board each for recording black ink and for recording color ink, for example. However, this is not restrictive, and an arrangement may be made where short line heads that are shorter than the width of the recording medium are formed, with multiple recording element boards arrayed so that orifices overlap in the discharge orifice row direction, these being scanned over the recording medium.

First Application Example

An application example to which the present invention can be suitably applied will be described below.

Description of Inkjet Recording Apparatus

Figure 1:
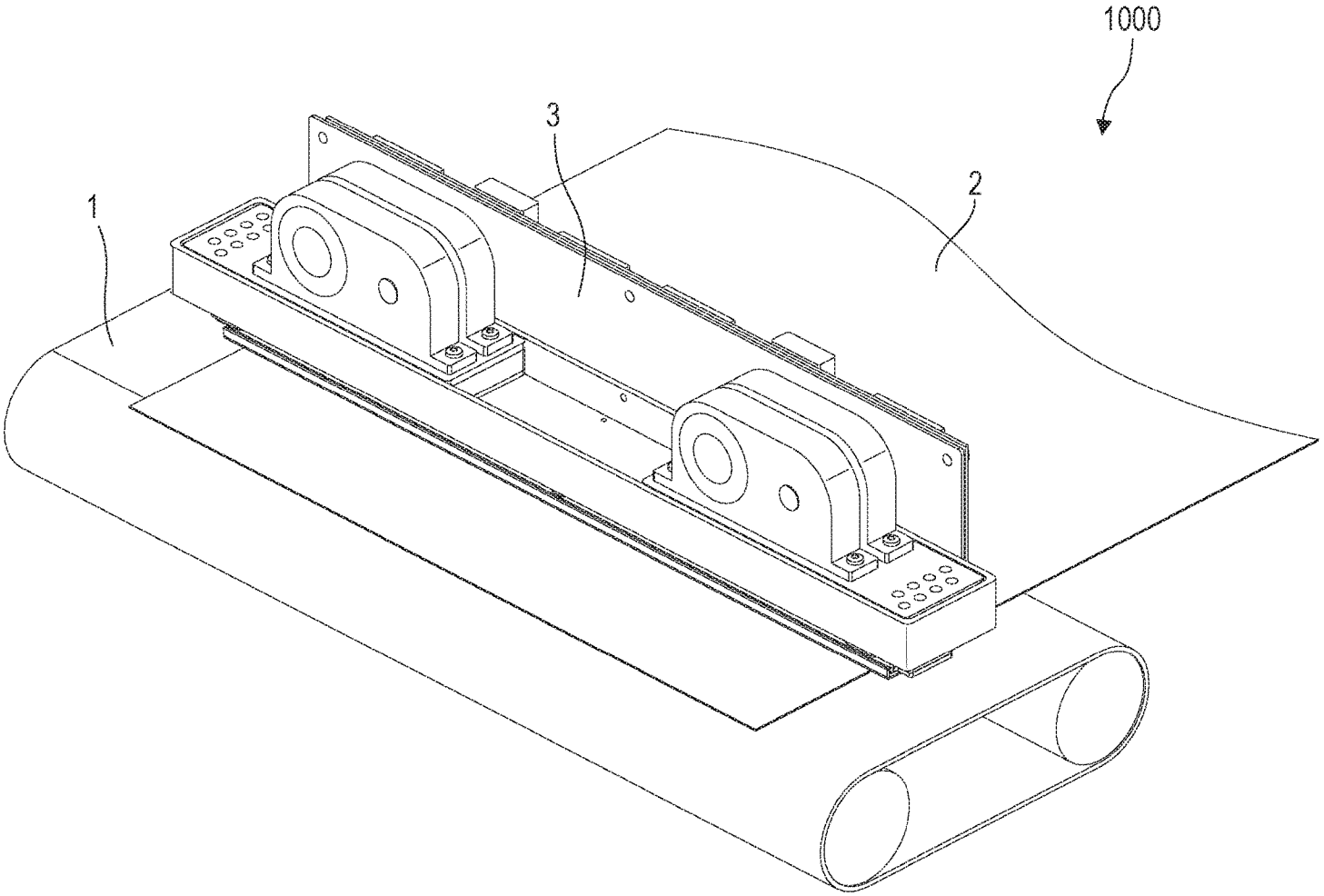
FIG. 1 is a diagram illustrating a schematic configuration of a recording apparatus according to a first application example of the present invention.

FIG. 1 illustrates a schematic configuration of a device that discharges liquid, and more particularly an inkjet recording apparatus 1000 (hereinafter also referred to simply as "recording apparatus") that performs recording by discharging ink. The recording apparatus 1000 has a conveyance unit 1 that conveys a recording medium 2, and a line type liquid discharge head 3 disposed generally orthogonal to the conveyance direction of the recording medium 2, and is a line type recording apparatus that performs single-pass continuous recording while continuously or intermittently conveying multiple recording mediums 2. The recording medium 2 is not restricted to cut sheets, and may be continuous roll sheets. The liquid discharge head 3 is capable of full-color printing by cyan, magenta, yellow, and black (acronym "CMYK") ink. The liquid discharge head 3 has a liquid supply unit serving as a supply path that supplies ink to the liquid discharge head 3, a main tank, and a buffer tank (see FIG. 2) connected by fluid connection, as described later. The liquid discharge head 3 is also electrically connected to an electric control unit that transmits electric power and discharge control signals to the liquid discharge head 3. Liquid paths and electric signal paths within the liquid discharge head 3 will be described later.

Description of First Circulation Path

Figure 2:
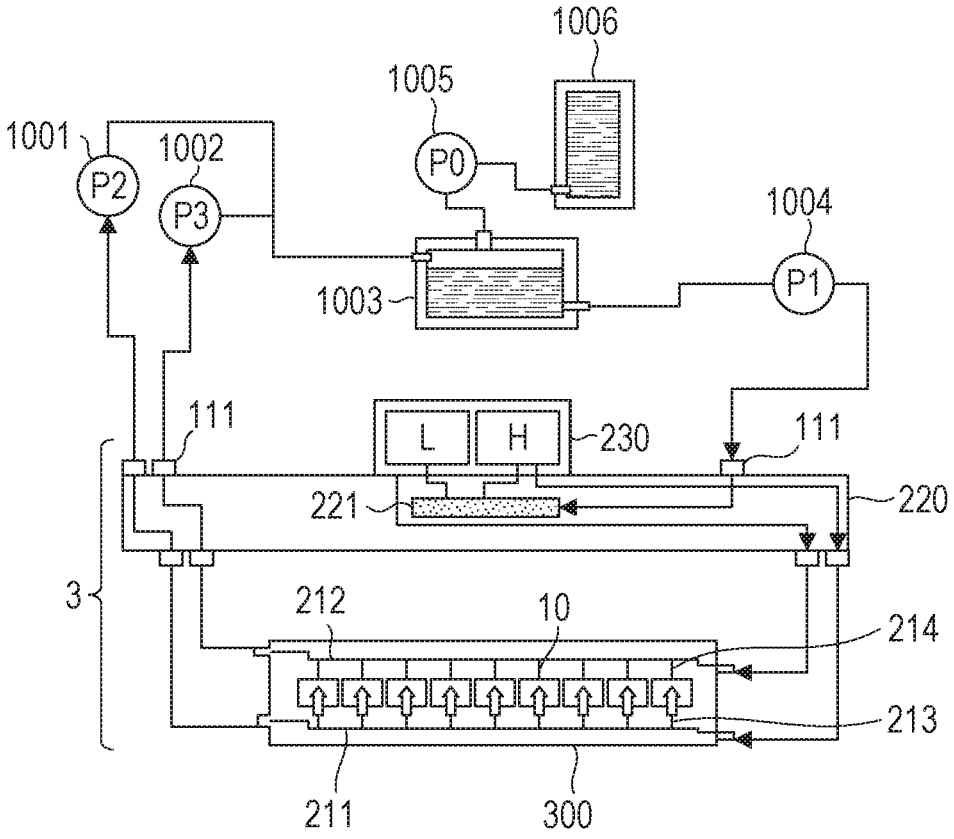
FIG. 2 is a diagram illustrating a first circulation path over which liquid circulates in the recording apparatus.

FIG. 2 is a schematic diagram illustrating a first circulation path that is a first form of a circulation path applied to the recording apparatus of the present application example. FIG. 2 is a diagram illustrating a first circulation pump (high-pressure side) 1001, a first circulation pump (low-pressure side) 1002 and a buffer tank 1003 and the like connected to the liquid discharge head 3 by fluid connection. Although FIG. 2 only illustrates the paths over which one color ink out of the CMYK ink flows, for the sake of brevity of description, in reality there are four colors worth of circulation paths provided to the liquid discharge head 3 and the recording apparatus main unit. The buffer tank 1003, serving as a sub-tank that is connected to a main tank 1006, has an atmosphere communication opening (omitted from illustration) whereby the inside and the outside of the tank communicate, and bubbles within the ink can be discharged externally. The buffer tank 1003 is also connected to a replenishing pump 1005. When ink is consumed at the liquid discharge head 3, when discharging (ejecting) ink from the discharge orifices of the liquid discharge head 3, by discharging ink to perform recording, suction recovery, or the like, for example, the replenishing pump 1005 acts to send ink of an amount the same as that has been consumed from the main tank 1006 to the buffer tank 1003.

The two first circulation pumps 1001 and 1002 act to extract ink from a liquid connection portion 111 of the liquid discharge head 3 and flow the ink to the buffer tank 1003. The first circulation pumps 1001 and 1002 preferably are positive-displacement pumps that have quantitative fluid sending capabilities. Specific examples may include tube pumps, gear pumps, diaphragm pumps, syringe pumps, and so forth. An arrangement may also be used where a constant flow is ensured by disposing a common-use constant-flow valve and relief valve at the outlet of the pump, for example. When the liquid discharge head 3 is being driven, the first circulation pump (high-pressure side) 1001 and first circulation pump (low-pressure side) 1002 cause a constant amount of ink to flow through a common supply channel 211 and a common recovery channel 212. The amount of flow is preferably set to a level where temperature difference among recording element boards 10 of the liquid discharge head 3 does not influence recording image quality, or higher. On the other hand, if the flow rate is set excessively high, the effects of pressure drop in the channels within a liquid discharge unit 300 causes excessively large difference in negative pressure among the recording element boards 10, resulting in unevenness in density in the image. Accordingly, the flow rate is preferably set taking into consideration temperature difference and negative pressure difference among the recording element boards 10.

A negative pressure control unit 230 is provided between paths of a second circulation pump 1004 and the liquid discharge unit 300. The negative pressure control unit 230 functions such that the pressure downstream from the negative pressure control unit 230 (i.e., at the liquid discharge unit 300 side) can be maintained at a present constant pressure even in cases where the flow rate of the circulation system fluctuates due to difference in duty when recording. Any mechanism may be used as two pressure adjustment mechanisms making up the negative pressure control unit 230, as long as pressure downstream from itself can be controlled to fluctuation within a constant range or smaller that is centered on a desired set pressure. As one example, a mechanism equivalent to a so-called "pressure-reducing regulator" can be employed. In a case of using a pressure-reducing regulator, the upstream side of the negative pressure control unit 230 is preferably pressurized by the second circulation pump 1004 via a liquid supply unit 220, as illustrated in FIG. 2. This enables the effects of water head pressure as to the liquid discharge head 3 of the buffer tank 1003 to be suppressed, giving broader freedom in the layout of the buffer tank 1003 in the recording apparatus 1000. It is sufficient that the second circulation pump 1004 have a certain lift pressure or greater, within the range of the circulatory flow of ink used when driving the liquid discharge head 3, and turbo pumps, positive-displacement pumps, and the like can be used. Specifically, diaphragm pumps or the like can be used. Alternatively, a water head tank disposed with a certain water head difference as to the negative pressure control unit 230, for example, may be used instead of the second circulation pump 1004.

As illustrated in FIG. 2, the negative pressure control unit 230 has two pressure adjustment mechanisms, with different control pressure from each other having been set. Of the two negative pressure adjustment mechanisms, the relatively high-pressure setting side (denoted by H in FIG. 2) and the relatively low-pressure setting side (denoted by L in FIG. 2) are respectively connected to the common supply channel 211 and the common recovery channel 212 within the liquid discharge unit 300 via the liquid supply unit 220. Provided to the liquid discharge unit 300 are individual supply channels 213 and individual recovery channels 214 communicating between the common supply channel 211, common recovery channel 212, and the recording element boards 10. Due to the individual supply channels 213 and 214 communicating with the common supply channel 211 and common recovery channel 212, flows occur where part of the ink flows from the common supply channel 211 through internal channels in the recording element board 10 and to the common recovery channel 212 (indicated by the arrows in FIG. 2). The reason is that the pressure adjustment mechanism H is connected to the common supply channel 211, and the pressure adjustment mechanism L to the common recovery channel 212, so a pressure difference is generated between the two common channels.

Thus, flows occur within the liquid discharge unit 300 where a part of the ink passes through the recording element boards 10 while ink flows through each of the common supply channel 211 and common recovery channel 212. Accordingly, heat generated at the recording element boards 10 can be externally discharged from the recording element boards 10 by the flows through the common supply channel 211 and common recovery channel 212. This configuration also enables ink flows to be generated at discharge orifices and pressure chambers not being used for recording while recording is being performed by the liquid discharge head 3, so thickening of the ink at such portions can be suppressed. Further, thickened ink and foreign substances in the ink can be discharged to the common recovery channel 212. Accordingly, the liquid discharge head 3 according to the present application example can record at high speed with high image quality.

Description of Second Circulation Path

Figure 3:
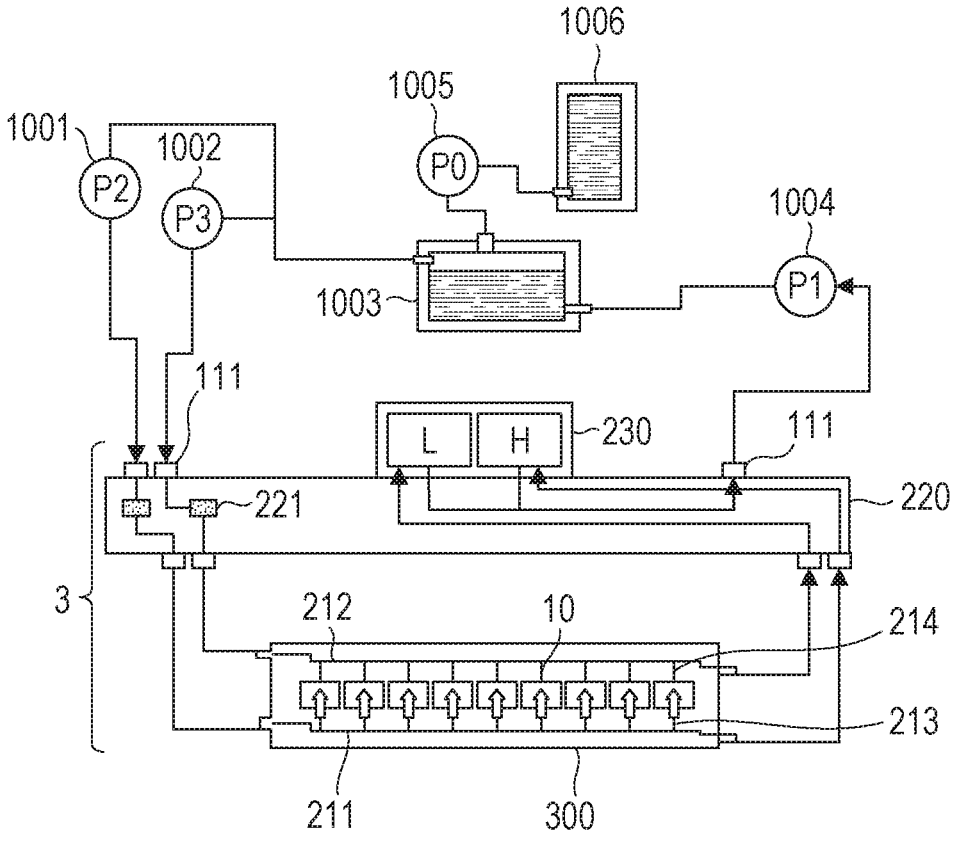
FIG. 3 is a diagram illustrating a second circulation path in the recording apparatus.

FIG. 3 is a schematic diagram that illustrates, of circulation paths applied to the recording apparatus according to the present application example, a second circulation path that is a different circulation form from the above-described first circulation path. The primary points of difference as to the above-described first circulation path are as follows. First, both of the two pressure adjustment mechanisms making up the negative pressure control unit 230 have a mechanism (a mechanism part having operations equivalent to a so-called "backpressure regulator") to control pressure at the upstream side from the negative pressure control unit 230 to fluctuation within a constant range that is centered on a desired set pressure. Next, the second circulation pump 1004 acts as a negative pressure source to depressurize the downstream side from the negative pressure control unit 230. Further, the first circulation pump (high-pressure side) 1001 and first circulation pump (low-pressure side) 1002 are disposed on the upstream side of the liquid discharge head 3, and the negative pressure control unit 230 is disposed on the downstream side of the liquid discharge head 3.

The negative pressure control unit 230 in FIG. 3 acts to maintain pressure fluctuation on the upstream side of itself (i.e., at the liquid discharge unit 300 side) within a constant range centered on a pressure set beforehand, even in cases where the flow rate fluctuates due to difference in recording duty when recording with the liquid discharge head 3. The downstream side of the negative pressure control unit 230 is preferably pressurized by the second circulation pump 1004 via the liquid supply unit 220, as illustrated in FIG. 3. This enables the effects of water head pressure of the buffer tank 1003 as to the liquid discharge head 3 to be suppressed, giving a broader range of selection for the layout of the buffer tank 1003 in the recording apparatus 1000. Alternatively, a water head tank disposed with a certain water head difference as to the negative pressure control unit 230, for example, may be used instead of the second circulation pump 1004.

The negative pressure control unit 230 illustrated in FIG. 3 has two pressure adjustment mechanisms, with different control pressure from each other having been set, in the same way as the arrangement illustrated in FIG. 2. Of the two negative pressure adjustment mechanisms, the relatively high-pressure setting side (denoted by H in FIG. 3) and the relatively low-pressure setting side (denoted by L in FIG. 3) are respectively connected to the common supply channel 211 and the common recovery channel 212 within the liquid discharge unit 300 via the liquid supply unit 220. The pressure of the common supply channel 211 is made to be relatively higher than the pressure of the common recovery channel 212 by the two negative pressure adjustment mechanisms. Accordingly, flows occur where ink flows from the common supply channel 211 through individual channels 213 and 214 and internal channels in the recording element board 10 to the common recovery channel 212 (indicated by the arrows in FIG. 3). The second circulation path thus yields an ink flow state the same as that of the first circulation path within the liquid discharge unit 300, but has two advantages that are different from the case of the first circulation path.

One advantage is that, with the second circulation path, the negative pressure control unit 230 is disposed on the downstream side of the liquid discharge head 3, so there is little danger that dust and foreign substances generated at the negative pressure control unit 230 will flow into the head. A second advantage is that the maximum value of the necessary flow rate supplied from the buffer tank 1003 to the liquid discharge head 3 can be smaller in the second circulation path as compared to the case of the first circulation path. The reason is as follows. The total flow rate within the common supply channel 211 and common recovery channel 212 when circulating during recording standby will be represented by A. The value of A is defined as the smallest flow rate necessary to maintain the temperature difference in the liquid discharge unit 300 within a desired range in a case where temperature adjustment of the liquid discharge head 3 is performed during recording standby. Also, the discharge flow rate in a case of discharging ink from all discharge orifices of the liquid discharge unit 300 (full discharge) is defined as F. Accordingly, in the case of the first circulation path (FIG. 2), the set flow rate of the first circulation pump (high-pressure side) 1001 and the first circulation pump (low-pressure side) 1002 is A, so the maximum value of the liquid supply amount to the liquid discharge head 3 necessary for full discharge is A+F.

On the other hand, in the case of the second circulation path (FIG. 3), the liquid supply amount to the liquid discharge head 3 necessary at the time of recording standby is flow rate A. This means that the supply amount to the liquid discharge head 3 that is necessary for full discharge is flow rate F. Accordingly, in the case of the second circulation path, the total value of the set flow rate of the first circulation pump (high-pressure side) 1001 and the first circulation pump (low-pressure side) 1002, i.e., the maximum value of the necessary supply amount, is the larger value of A and F. Thus, the maximum value of the necessary supply amount in the second circulation path (A or F) is always smaller than the maximum value of the necessary supply flow rate in the first circulation path (A+F), as long as the liquid discharge unit 300 of the same configuration is used. Consequently, the degree of freedom regarding circulatory pumps that can be applied is higher in the case of the second circulation path, and low-cost circulatory pumps having simple structure can be used, the load on a cooler (omitted from illustration) disposed on the main unit side path can be reduced, for example, thereby reducing costs of the recording apparatus main unit. This advantage is more pronounced with line heads where the values of A or F are relatively great, and is more useful the longer the length of the line head is in the longitudinal direction.

However, on the other hand there are points where the first circulation path is more advantageous than the second circulation path. That is to say, with the second circulation path, the flow rate flowing through the liquid discharge unit 300 at the time of recording standby is maximum, so the lower the recording duty of the image is, the greater a negative pressure is applied to the nozzles. Accordingly, in a case where the channel widths of the common supply channel 211 and common recovery channel 212 (the length in a direction orthogonal to the direction of flow of ink) is reduced to reduce the head width (the length of the liquid discharge head in the transverse direction) in particular, this may result in more influence of satellite droplets. The reason is that high negative pressure is applied to the nozzles in low-duty images where unevenness is conspicuous. On the other hand, high negative pressure is applied to the discharge orifices when forming high-duty images in the case of the first circulation path, so any generated satellites are less conspicuous, which is advantageous in that influence on the image quality is small. Which of these two circulation paths is more preferable can be selected in light of the specifications of the liquid discharge head and recording apparatus main unit (discharge flow rate F, smallest circulatory flow rate A, and channel resistance within the head).

Description of Configuration of Liquid Discharge Head

Figure 4A:
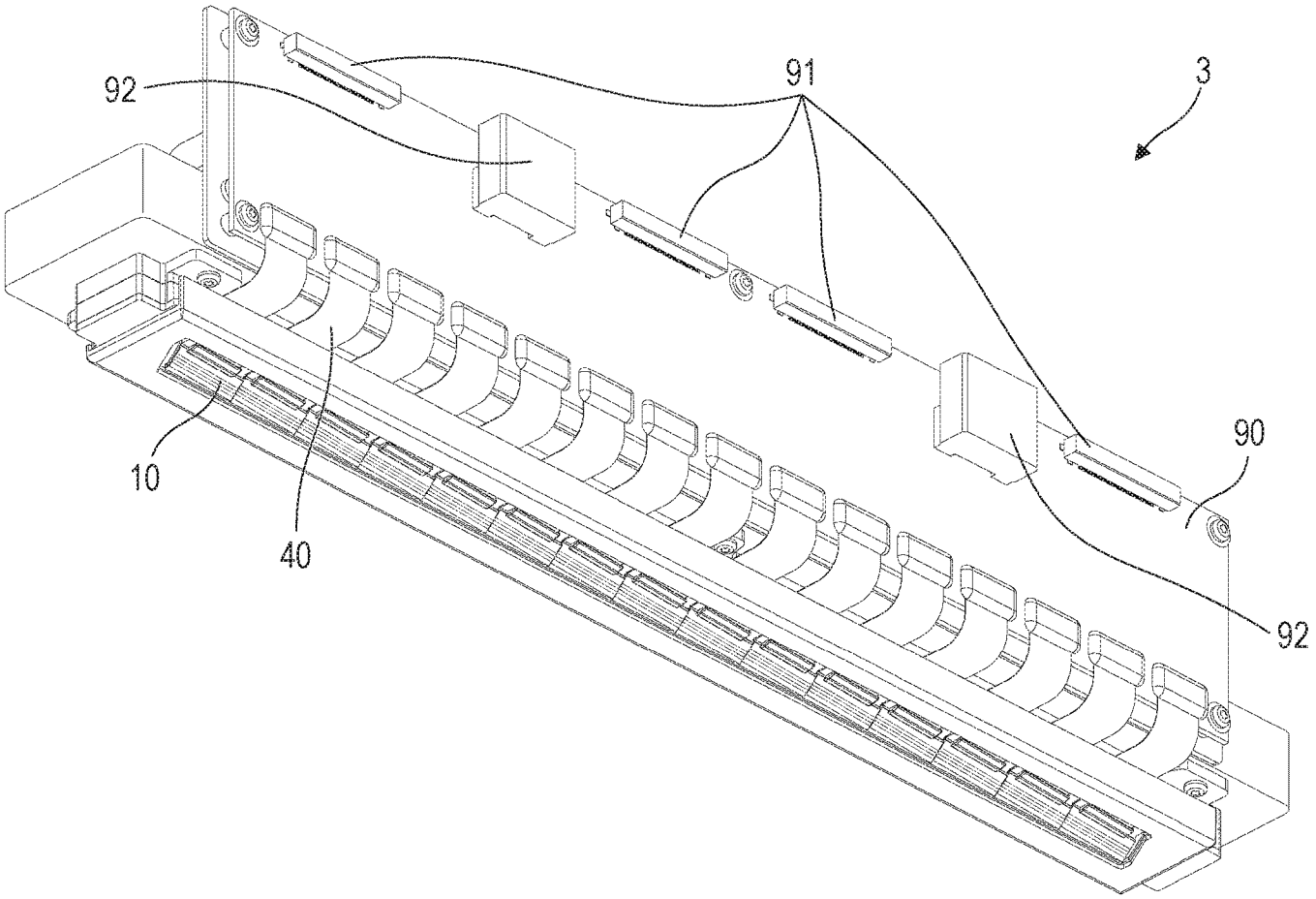
FIGS. 4A and 4B are perspective diagrams of a liquid discharge head according to the first application example of the present invention.
Figure 4B:
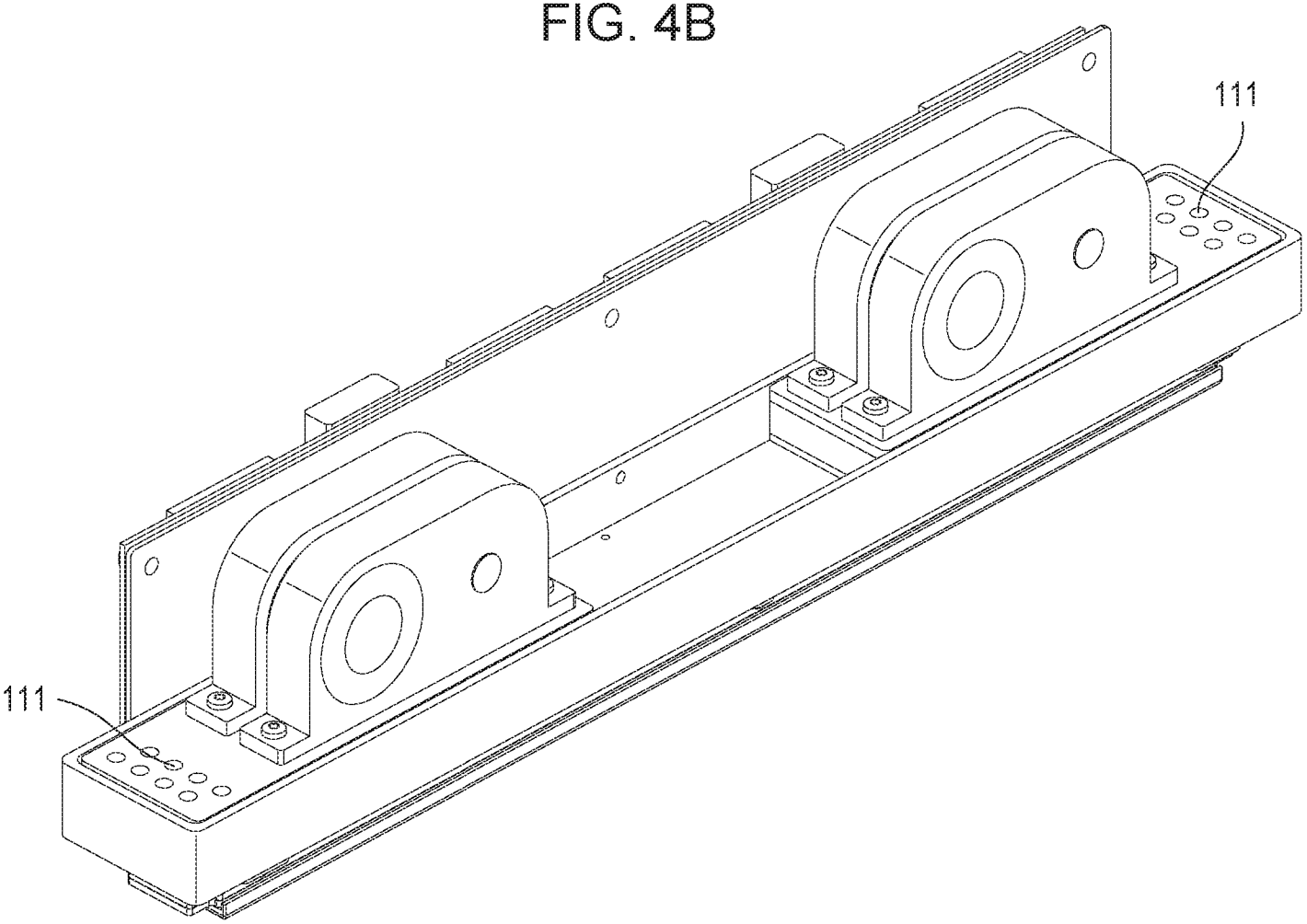

The configuration of the liquid discharge head 3 according to the first application example will be described. FIGS. 4A and 4B are perspective views of the liquid discharge head 3 according to the present application example. The liquid discharge head 3 is a line-type liquid discharge head where fifteen recording element boards 10 capable of discharging ink of the four colors of C, M, Y, and K are arrayed on a straight line (inline layout). The liquid discharge head 3 includes the recording element boards 10, and signal input terminals 91 and power supply terminals 92 that are electrically connected via flexible printed circuit boards 40 and an electric wiring board 90, as illustrated in FIG. 4A. The signal input terminals 91 and power supply terminals 92 are electrically connected to a control unit of the recording apparatus 1000, and each supply the recording element boards 10 with discharge drive signals and electric power necessary for discharge. Consolidating wiring by electric circuits in the electric wiring board 90 enables the number of signal input terminals 91 and power supply terminals 92 to be reduced in comparison with the number of recording element boards 10. This enables the number of electric connection portions that need to be removed when assembling the liquid discharge head 3 to the recording apparatus 1000 or when exchanging the liquid discharge head 3 to be reduced. Liquid connection portions 111 provided to both ends of the liquid discharge head 3 are connected with the liquid supply system of the recording apparatus 1000, as illustrated in FIG. 4B. Thus, ink of the four colors of CMYK is supplied from the supply system of the recording apparatus 1000 to the liquid discharge head 3, and ink that has passed through the liquid discharge head 3 is recovered to the supply system of the recording apparatus 1000. In this way, ink of each color can circulate over the path of the recording apparatus 1000 and the path of the liquid discharge head 3.

Figure 5:
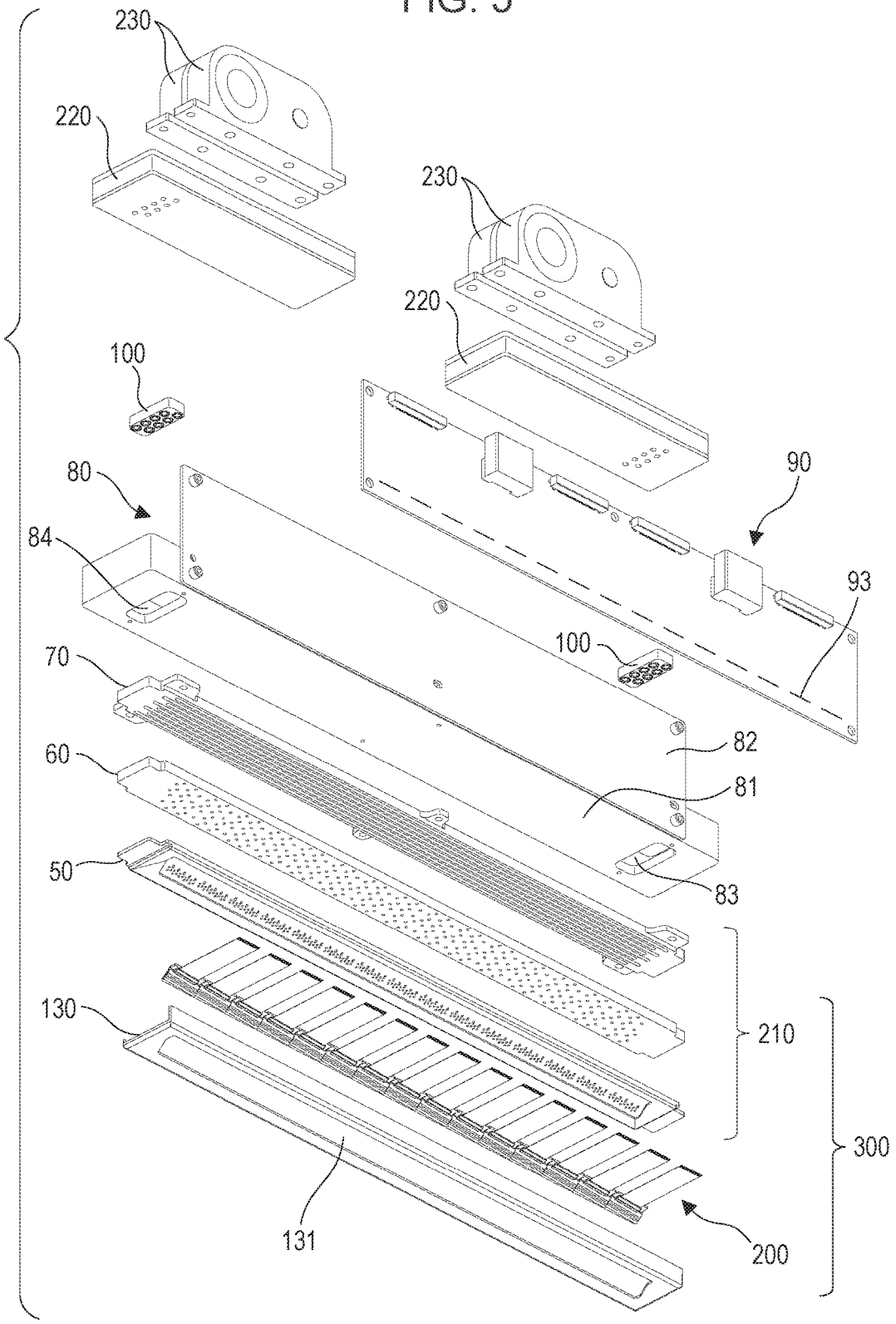
FIG. 5 is a disassembled perspective view of the liquid discharge head in FIG. 4.

FIG. 5 illustrates a disassembled perspective view of parts and units making up the liquid discharge head 3. The liquid discharge unit 300, liquid supply units 220, and electric wiring board 90 are attached to a case 80. The liquid connection portions 111 (FIG. 3) are provided to the liquid supply unit 220, and filters 221 (FIGS. 2 and 3) for each color, that communicate with each opening of the liquid connection portions 111 to remove foreign substances in the supplied ink, are provided inside the liquid supply units 220. Two liquid supply units 220 are each provided with filters 221 for two colors. The inks that have passed through the filters 221 are supplied to the respective negative pressure control units 230 provided on the liquid supply units 220 corresponding to each color. Each negative pressure control unit 230 is a unit made up of a pressure adjustment valve for its respective color. The negative pressure control units 230 markedly attenuate change in pressure drop in the supply system of the recording apparatus 1000 (supply system on the upstream side of the liquid discharge head 3) occurring due to fluctuation in the flow rate of ink, by the operations of valve and spring members and the like provided therein. Accordingly, change of negative pressure at the downstream side from the pressure control units (liquid discharge unit 300 side) can be stabilized to within a certain range. Each negative pressure control unit 230 for each color has two pressure adjustment valves built in, as described in FIG. 2, and are each set to different control pressures. The two pressure adjustment valves communicate with the common supply channel 211 within the liquid discharge unit 300 at the high pressure side, and with the common recovery channel 212 at the low-pressure side, via the liquid supply unit 220.

The case 80 is configured including a liquid discharge unit support member 81 and electric wiring board support member 82, and supports the liquid discharge unit 300 and electric wiring board 90 as well as securing rigidity of the liquid discharge head 3. The electric wiring board support member 82 is for supporting the electric wiring board 90, and is fixed by being screwed to the liquid discharge unit support member 81. The liquid discharge unit support member 81 serves to correct warping and deformation of the liquid discharge unit 300, and thus secure relative positional accuracy of the multiple recording element boards 10, thereby suppressing unevenness in the recorded article. Accordingly, the liquid discharge unit support member 81 preferably has sufficient rigidity. Examples of suitable materials include metal materials such as stainless steel and aluminum, and ceramics such as alumina. The liquid discharge unit support member 81 has openings 83 and 84 into which joint rubber members 100 are inserted. Ink supplied from a liquid supply unit 220 passes through a joint rubber member 100 and is guided to a third channel member 70 which is a part making up the liquid discharge unit 300.

The liquid discharge unit 300 is made up of multiple discharge modules 200 and a channel member 210, and a cover member 130 is attached to the face of the liquid discharge unit 300 that faces the recording medium. The cover member 130 is a member having a frame-shaped face where a long opening 131 is provided. The recording element boards 10 included in the discharge module 200 and a sealing member 110 (FIG. 9A) are exposed from the opening 131, as illustrated in FIG. 5. The frame portion on the perimeter of the opening 131 functions as a contact surface for a cap member that caps off the liquid discharge head 3 when in recording standby. Accordingly, a closed space is preferably formed when capping, by coating the perimeter of the opening 131 with an adhesive agent, sealant, filling member, or the like, to fill in roughness and gaps on the discharge orifice face of the liquid discharge unit 300.

Next, description will be made regarding the configuration of the channel member 210 included in the liquid discharge unit 300. The channel member 210 is an article formed by laminating a first channel member 50, a second channel member 60, and the third channel member 70, as illustrated in FIG. 5. The channel member 210 is a channel member that distributes the ink supplied from the liquid supply unit 220 to each of the discharge modules 200, and returns ink recirculating from the discharge modules 200 to the liquid supply unit 220. The channel member 210 is fixed to the liquid discharge unit support member 81 by screws, thereby suppressing warping and deformation of the channel member 210.

Figure 6A:
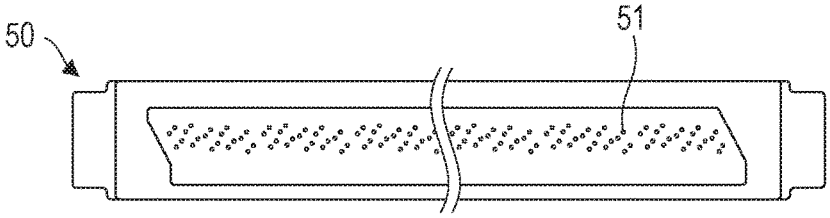
FIGS. 6A through 6F are diagrams illustrating the configuration of first through third channel members making up a channel member that the liquid discharge head in FIG. 4 has.
Figure 6B:
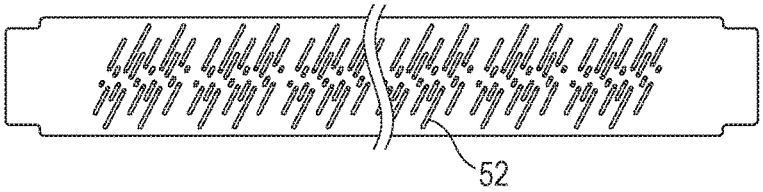
Figure 6C:
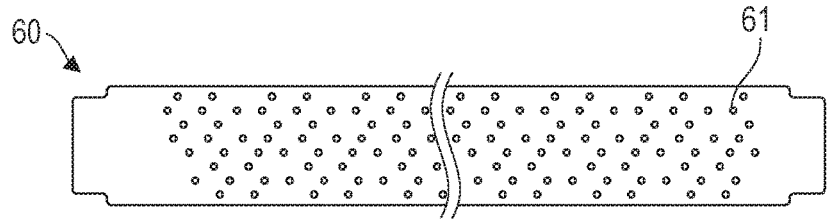
Figure 6D:
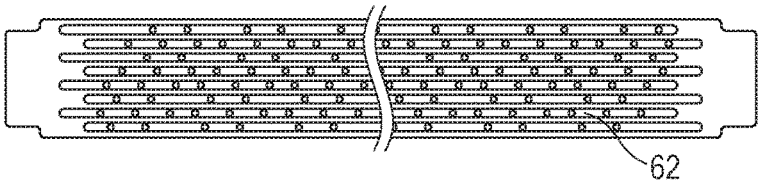
Figure 6E:
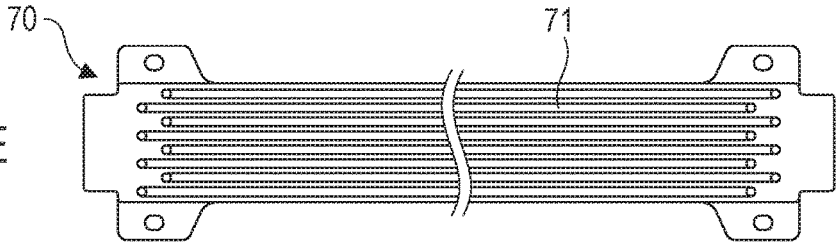
Figure 6F:
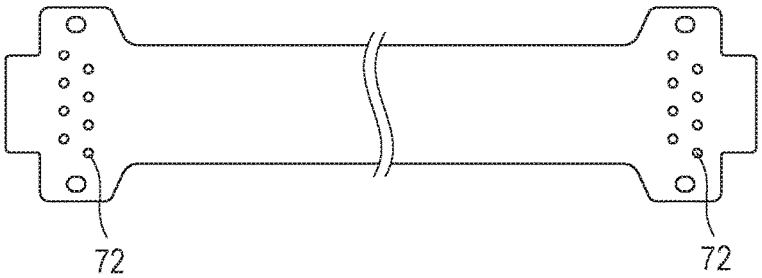
Figure 7:
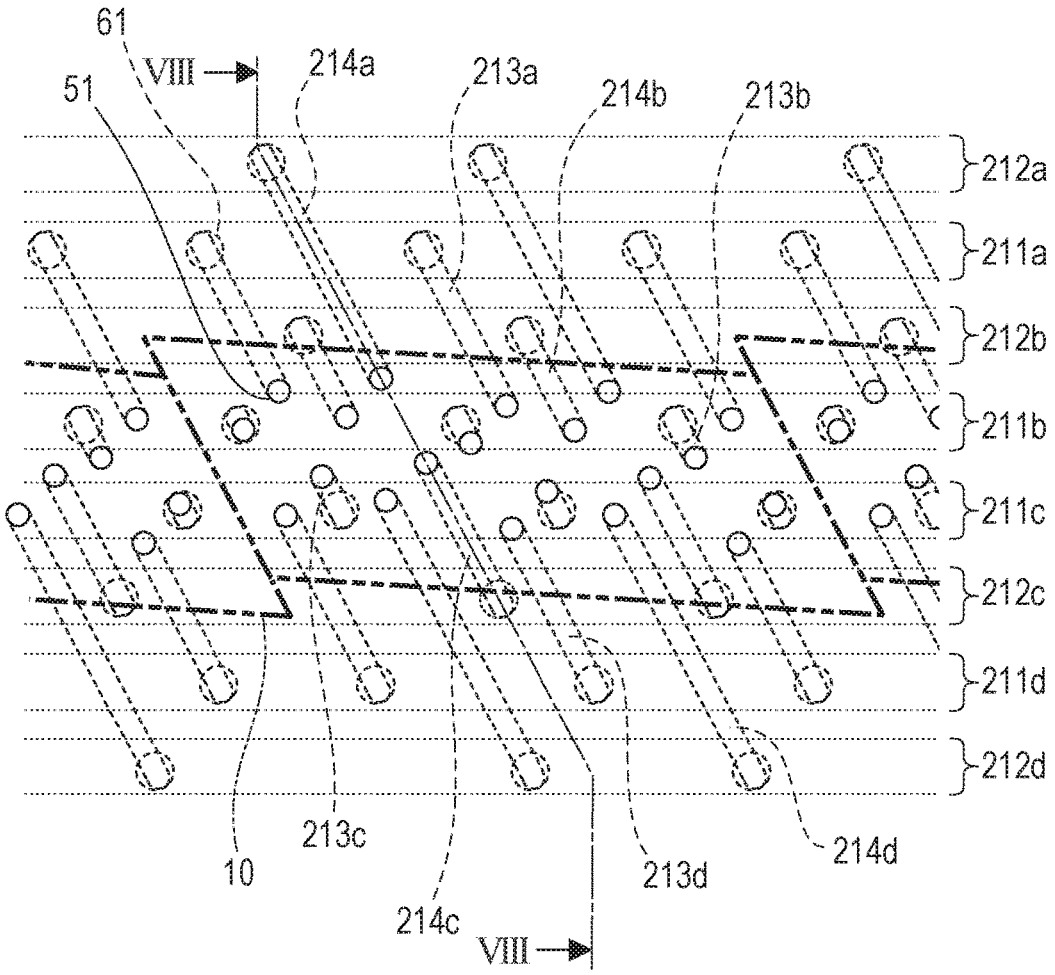
FIG. 7 is a diagram for describing connection relationships between channels within the channel member.

FIGS. 6A through 6F are diagrams illustrating the front and rear sides of the channel members making up the first through third channel members. FIG. 6A illustrates the side of the first channel member 50 on which the discharge modules 200 are mounted, and FIG. 6F illustrates the face of the third channel member 70 that comes in contact with the liquid discharge unit support member 81. The first channel member 50 and second channel member 60 have mutually adjoining channel member contact faces, illustrated in FIGS. 6B and 6C respectively, as do the second channel member 60 and third channel member 70 as illustrated in FIGS. 6D and 6E. The adjoining second channel member 60 and third channel member 70 have formed thereupon common channel grooves 62 and 71 which, when facing each other, form eight common channels extending in the longitudinal direction of the channel members. This forms a set of common supply channels 211 and common recovery channels 212 for each of the colors within the channel member 210 (FIG. 7). Communication ports 72 of the third channel member 70 communicate with the holes in the joint rubber members 100, so as to communicate with the liquid supply unit 220 by fluid connection. Multiple communication ports 61 are formed on the bottom face of the common channel grooves 62 of the second channel member 60, communicating with one end of individual channel grooves 52 of the first channel member 50. Communication ports 51 are formed at the other end of the individual channel grooves 52 of the first channel member 50 so as to communicate with the multiple discharge modules 200 by fluid connection via the communication ports 51. These individual channel grooves 52 allow the channels to be consolidated at the middle of the channel member.

The first through third channel members preferably are corrosion-resistant as to the ink, and formed from a material having a low linear expansion coefficient. Examples suitable materials include alumina, liquid crystal polymer (LCP), and composite materials (resin materials) where inorganic filler such as fine particles of silica or fiber or the like has been added to a base material such as polyphenyl sulfide (PPS), polysulfone (PSF), or denatured polyphenylene ether (PPE). The channel member 210 may be formed by laminating the three channel members and adhering using an adhesive agent, or in a case of selecting a composite resin material for the material, the three channel members may be joined by fusing.

Next, the connection relationship of the channels within the channel member 210 will be described with reference to FIG. 7. FIG. 7 is a partially enlarged transparent view of channels within the channel member 210 formed by joining the first through third channel members, as viewed from the side of the first channel member 50 on which the discharge modules 200 are mounted. The channel member 210 has, for each color, common supply channels 211 (211*a*, 211*b*, 211*c*, and 211*d*) and common recovery channels 212 (212*a*, 212*b*, 212*c*, and 212*d*) extending on the longitudinal direction of the liquid discharge head 3. Multiple individual supply channels 213 (213*a*, 213*b*, 213*c*, and 213*d*) formed of the individual channel grooves 52 are connected to the common supply channels 211 of each color via the communication ports 61. Multiple individual recovery channels 214 (214*a*, 214*b*, 214*c*, and 214*d*) formed of the individual channel grooves 52 are connected to the common recovery channels 212 of each color via the communication ports 61. This channel configuration enables ink to be consolidated at the recording element boards 10 situated at the middle of the channel members, from the common supply channels 211 via the individual supply channels 213. Ink can also be recovered from the recording element boards 10 to the common recovery channels 212 via the individual recovery channels 214.

Figure 8:
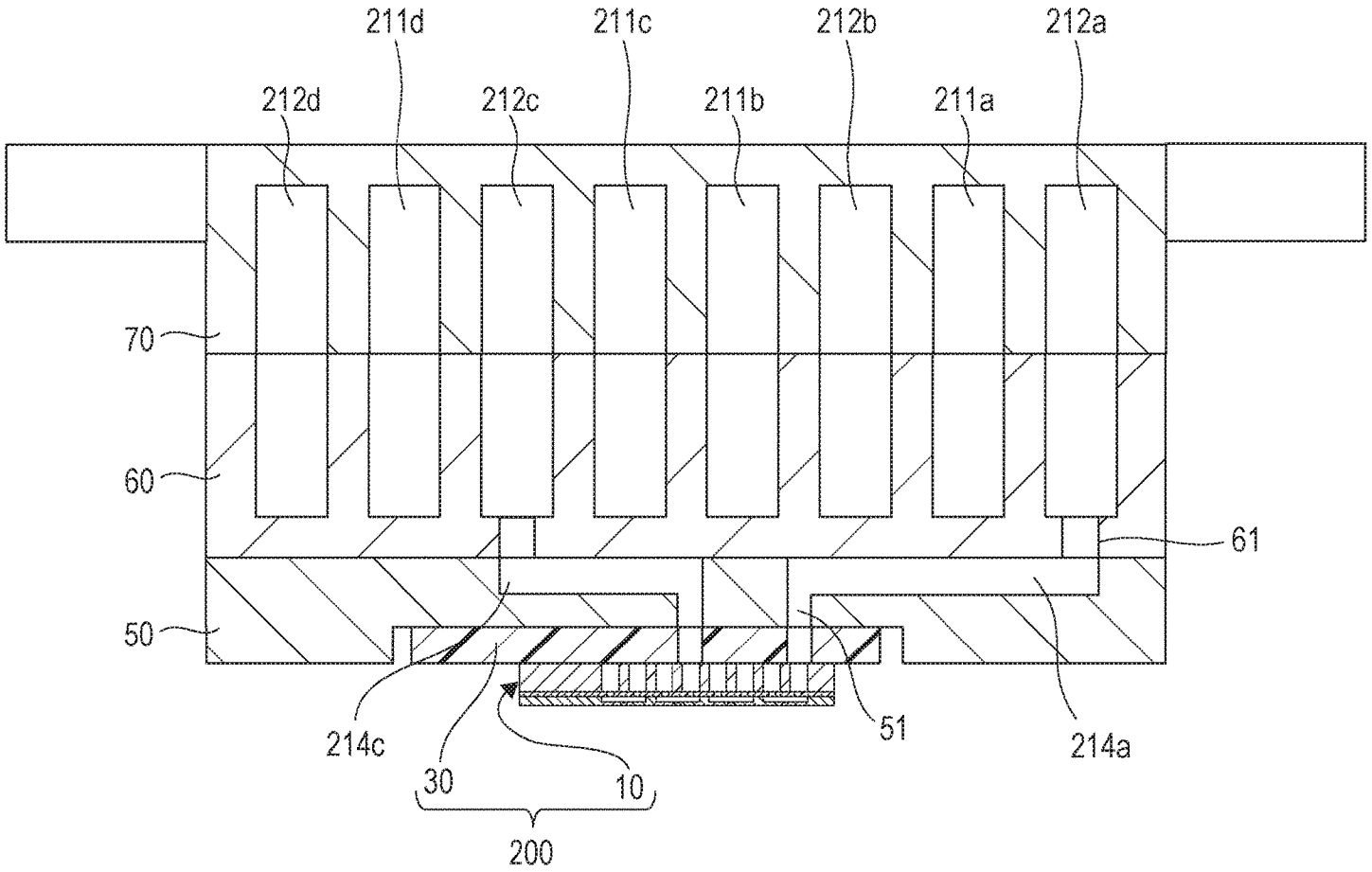
FIG. 8 is a cross-sectional view taken along line VIII-VIII in FIG. 7.

FIG. 8 is a cross-sectional view taken along line VIII-VIII in FIG. 7, illustrating that individual recovery channels (214*a* and 214*c*) communicate with the discharge module 200 via the communication ports 51. Although FIG. 8 only illustrates the individual recovery channels (214*a* and 214*c*), the individual supply channels 213 and the discharge module 200 communicate at a different cross-section, as illustrated in FIG. 7. Channels are formed in the support member 30 and recording element boards 10 included in the discharge module 200. The channels are for supplying ink from the first channel member 50 to the recording elements 15 (FIG. 10B) provided to the recording element board 10, and collecting (recirculating) part or all of the ink supplied to the recording elements 15 to the first channel member 50. The common supply channels 211 of each color is connected to the negative pressure control unit 230 (high-pressure side) of the corresponding color via its liquid supply unit 220, and the common recovery channels 212 are connected to the negative pressure control units 230 (low-pressure side) via the liquid supply units 220. The negative pressure control units 230 generate differential pressure (pressure difference) between the common supply channels 211 and common recovery channels 212. Accordingly, a flow occurs for each color in the liquid discharge head 3 according to the present application example where the channels are connected as illustrated in FIGS. 7 and 8, in the order of common supply channel 211→individual supply channels 213→recording element boards 10→individual recovery channels 214→common recovery channel 212.

Description of Discharge Module

Figure 9A:
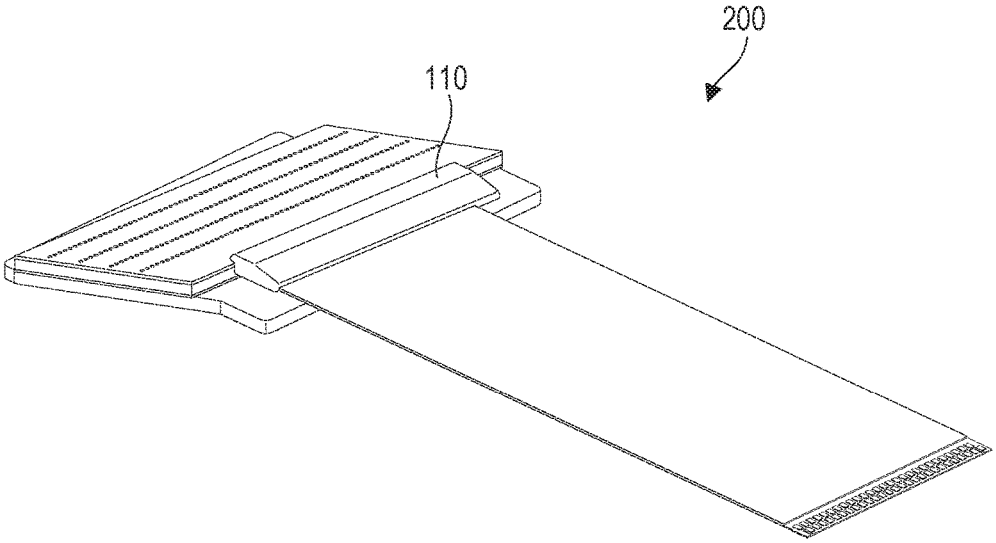
FIGS. 9A and 9B are diagrams illustrating a discharge module, FIG. 9A being a perspective view and FIG. 9B being a disassembled view.
Figure 9B:
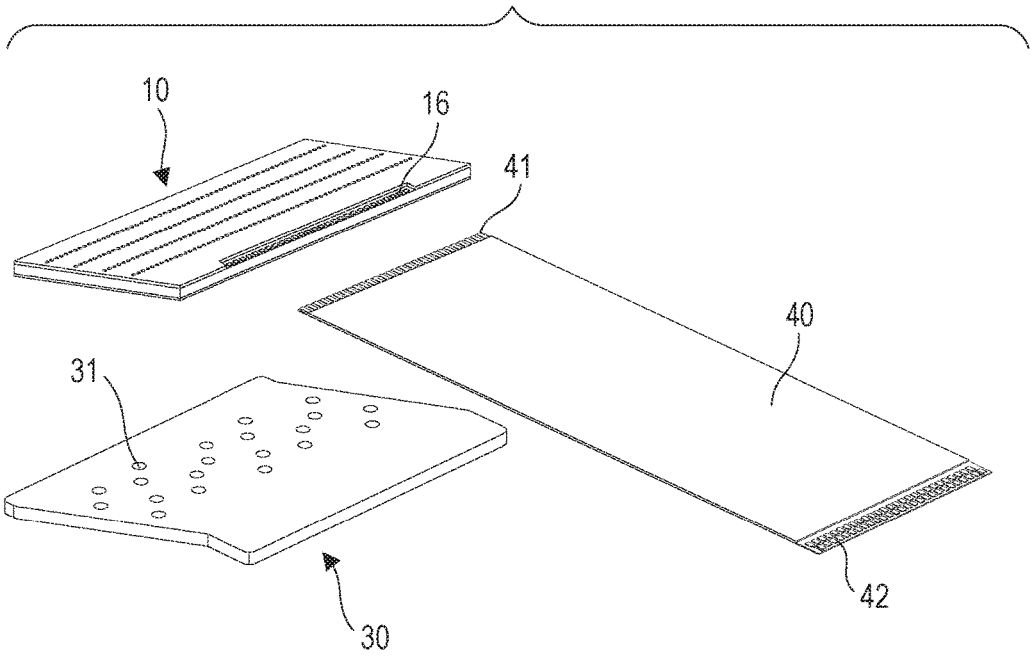

FIG. 9A illustrates a perspective view of one discharge module 200, and FIG. 9B illustrates a disassembled view thereof. The method of manufacturing the discharge module 200 is as follows. First, a recording element board 10 and flexible printed circuit board 40 are adhered to a support member 30 in which liquid communication ports 31 have been formed beforehand. Subsequently, terminals 16 on the recording element board 10 are electrically connected to terminals 41 on the flexible printed circuit board 40 by wire bonding, following which the wire-bonded portion (electric connection portion) is covered and sealed by a sealant 110. Terminals 42 at the other end of the flexible printed circuit board 40 from the recording element board 10 are electrically connected to connection terminals 93 (FIG. 5) of the electric wiring board 90. The support member 30 is a support member that supports the recording element board 10, and also is a channel member communicating between the recording element board 10 and the channel member 210 by fluid connection. Accordingly, the support member 30 should have a high degree of flatness, and also should be able to be joined to the recording element board 10 with a high degree of reliability. Examples of suitable materials include alumina and resin materials.

Description of Structure of Recording Element Board

Figure 10A:
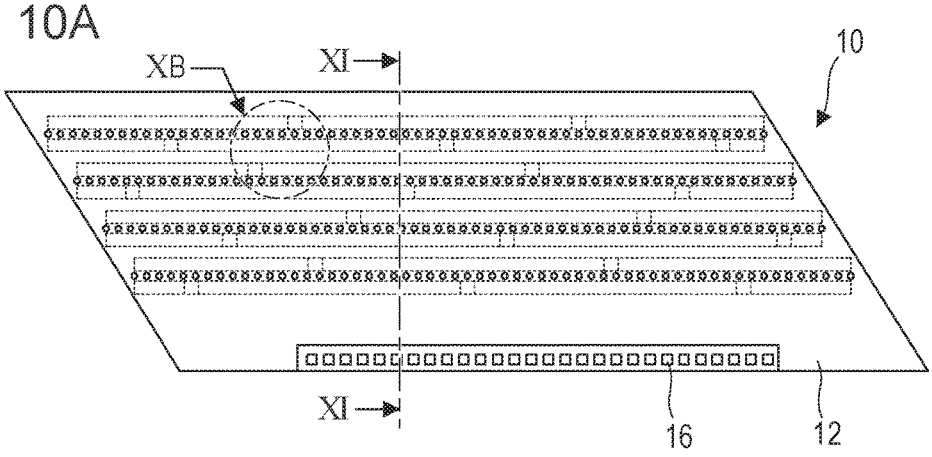
FIGS. 10A through 10C are diagrams illustrating the configuration of a recording element board.
Figure 10B:
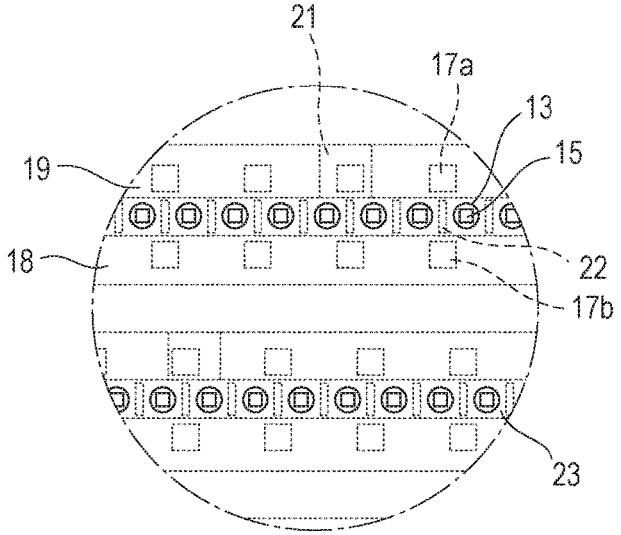
Figure 10C:
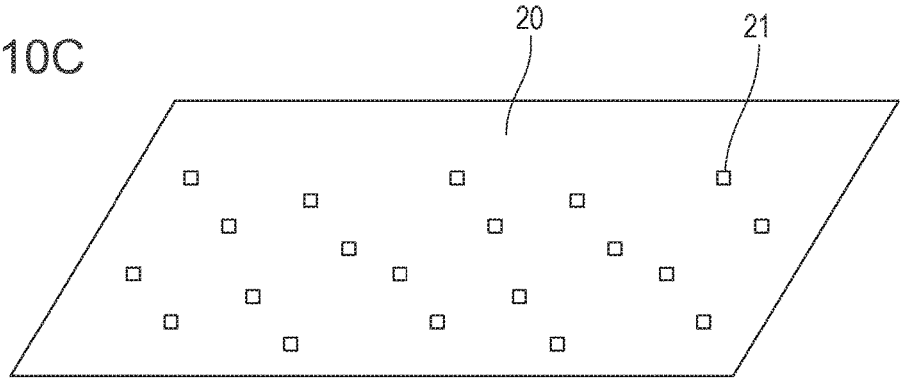

The configuration of the recording element board 10 according to the present application example will be described. FIG. 10A is a plan view of the side of the recording element board 10 on which discharge orifices 13 have been formed, FIG. 10B is an enlarged view of the portion indicated by XB in FIG. 10A, and FIG. 10C is a plan view of the rear face of the recording element board 10 from that in FIG. 10A. The recording element board 10 has a discharge orifice forming member 12, where four discharge orifice rows corresponding to the ink colors are formed, as illustrated in FIG. 10A. Note that hereinafter, the direction in which the discharge orifice rows, where multiple discharge orifices 13 are arrayed, extend, will be referred to as "discharge orifice row direction".

The recording elements 15, which are heating elements to cause bubbling of the ink due to thermal energy, are disposed at positions corresponding to the discharge orifices 13, as illustrated in FIG. 10B. Pressure chambers 23 that contain the recording elements 15 are sectioned off by partitions 22. The recording elements 15 are electrically connected to the terminals 16 in FIG. 10A by electric wiring (omitted from illustration) provided to the recording element board 10. The recording elements 15 generate heat to cause the ink to boil, based on pulse signals input from a control circuit of the recording apparatus 1000, via the electric wiring board 90 (FIG. 5) and flexible printed circuit board 40 (FIG. 9B). The force of bubbling due to this boiling discharges ink from the discharge orifices 13. A liquid supply channel 18 extends along one side of each discharge orifice row, and a liquid recovery channel 19 along the other, as illustrated in FIG. 10B. The liquid supply channels 18 and liquid recovery channels 19 are channels extending in the direction of the discharge orifice rows provided on the recording element board 10, and communicate with the discharge orifices 13 via supply ports 17*a* and recovery ports 17*b*, respectively.

Figure 11:
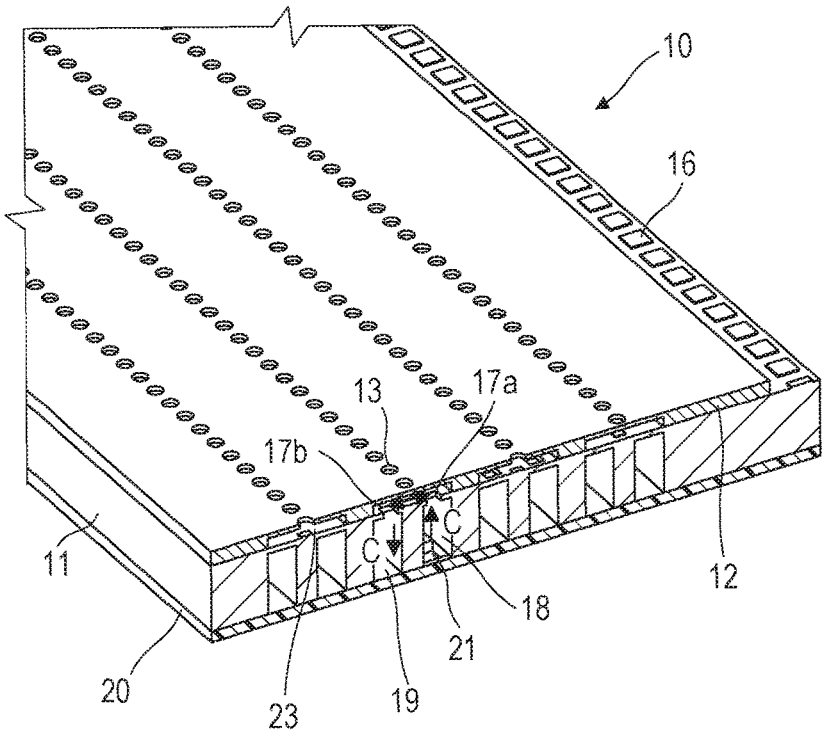
FIG. 11 is a perspective view illustrating the configuration of the recording element board including cross-section XI-XI in FIG. 10A and a cover.

A sheet-shaped cover 20 is laminated on the rear face from the face of the recording element board 10 on which the discharge orifices 13 are formed, the cover 20 having multiple openings 21 communicating with the liquid supply channel 18 and liquid recovery channel 19 which will be described later, as illustrated in FIGS. 10C and 11. In the present application example, three openings 21 are provided in the cover 20 for each liquid supply channel 18, and two openings 21 are provided for each liquid recovery channel 19. The number of the openings 21 provided to the channels is preferably a plurality, from the perspective of pressure drop. Multiple openings 21 do not have to be provided at each channel in the present embodiment, it is sufficient for at least two openings 21 to be provided to either one or the other of the liquid supply channel 18 and liquid recovery channel 19. For example, a configuration of the liquid discharge head 3 is sufficient to have two openings 21 at the liquid supply channel 18 and one opening 21 at the liquid recovery channel 19. The openings 21 of the cover 20 each communicate with the multiple communication ports 51 illustrated in FIG. 6A, as illustrated in FIG. 10B. The cover 20 functions as a lid that makes up part of the sides of the liquid supply channel 18 and liquid recovery channel 19 formed in the substrate 11 of the recording element board 10, as illustrated in FIG. 11. The cover 20 preferably is sufficiently corrosion-resistant as to the ink, and has to have a high degree of precision regarding the opening shapes of the openings 21 and the positions thereof from the perspective of color mixture prevention. Accordingly, a photosensitive resin material or silicon plate is preferably used as the material for the cover 20, with the openings 21 being formed by photolithography process. The cover 20 thus is for converting the pitch of channels by the openings 21. The cover 20 preferably is thin, taking into consideration pressure drop, and preferably is formed of a film-shaped resin material.

Next, the flow of ink within the recording element board 10 will be described. FIG. 11 is a perspective view, illustrating a cross-section of the recording element board 10 and cover 20 taken along plane XI-XI in FIG. 10A. The recording element board 10 is formed by laminating the substrate 11 formed of silicon (Si) and the discharge orifice forming member 12 formed of a photosensitive resin, with the cover 20 joined on the rear face of the substrate 11. The recording elements 15 are formed on the other face side of the substrate 11 (FIG. 10B) with the grooves making up the liquid supply channels 18 and liquid recovery channels 19 extending along the discharge orifice rows being formed at the reverse side thereof. The liquid supply channels 18 and liquid recovery channels 19 formed by the substrate 11 and cover 20 are respectively connected to the common supply channels 211 and common recovery channels 212 within the channel member 210, and there is differential pressure between the liquid supply channels 18 and liquid recovery channels 19. When ink is being discharged from multiple discharge orifices 13 of the liquid discharge head 3 and recording is being performed, the following flow is generated at discharge orifices 13 not performing discharge operations. That is to say, ink in the liquid supply channels 18 provided in the substrate 11 flows from the liquid supply channel 18 to the liquid recovery channel 19 via the supply channel 17*a*, pressure chamber 23, and recovery port 17*b* (The flow indicated by arrows C in FIG. 11) due to this differential pressure. This flow enables ink that has thickened due to evaporation from the discharge orifices 13, bubbles, foreign substance, and so forth, to be recovered to the liquid recovery channel 19 from the discharge orifices 13 and pressure chambers 23 where recording is not being performed. This also enables thickening of ink at the discharge orifices 13 and pressure chambers 23 to be suppressed. Ink recovered to the liquid recovery channels 19 is recovered in the order of the communication ports 51 in the channel member 210, the individual recovery channels 214, and the common recovery channel 212, via the openings 21 of the cover 20 and the liquid communication ports 31 of the support member 30 (see FIG. 9B). This ink is ultimately recovered to the supply path of the recording apparatus 1000.

That is to say, ink supplied from the recording apparatus main unit to the liquid discharge head 3 is supplied and recovered by flowing in the order described below. First, the ink flows from the liquid connection portions 111 of the liquid supply unit 220 into the liquid discharge head 3. The ink is next supplied to the joint rubber members 100, communication ports 72 and common channel grooves 71 provided to the third channel member 70, common channel grooves 62 and communication ports 61 provided to the second channel member 60, and individual channel grooves 52 and communication ports 51 provided to the first channel member 50, in that order. Thereafter, the ink is supplied to the pressure chambers 23 in the order of the liquid communication ports 31 provided to the support member 30, the openings 21 provided to the cover 20, and the liquid supply channels 18 and supply ports 17*a* provided to the substrate 11. Ink that has been supplied to the pressure chambers 23 but not discharged from the discharge orifices 13 flows in the order of the recovery ports 17*b* and liquid recovery channels 19 provided to the substrate 11, the openings 21 provided to the cover 20, and the liquid communication ports 31 provided to the support member 30. Thereafter, the ink flows in the order of the communication ports 51 and individual channel grooves 52 provided to the first channel member 50, the communication ports 61 and common channel grooves 62 provided to the second channel member 60, the common channel grooves 71 and communication ports 72 provided to the third channel member 70, and the joint rubber members 100. The ink further flows outside of the liquid discharge head 3 from the liquid connection portions 111 provided to the liquid supply unit. In the first circulation path illustrated in FIG. 2, ink that has flowed in from the liquid connection portions 111 passes through the negative pressure control unit 230 and then is supplied to the joint rubber members 100. In the second circulation path illustrated in FIG. 3, ink recovered from the pressure chambers 23 passes through the joint rubber members 100, and then flows out of the liquid discharge head 3 from the liquid connection portions 111 via the negative pressure control unit 230.

Also, not all ink flowing in from one end of the common supply channel 211 of the liquid discharge unit 300 is supplied to the pressure chamber 23 via the individual supply channels 213*a*, as illustrated in FIGS. 2 and 3. There is ink that flows from the other end of the common supply channel 211 and through the liquid supply unit 220 without ever entering the individual supply channels 213*a*. Thus, providing channels where ink flows without going through the recording element board 10 enables backflow in the circulatory flow of ink to be suppressed, even in a case where the recording element board 10 has fine channels where the flow resistance is great, as in the case of the present application example. Accordingly, the liquid discharge head according to the present application example is capable of suppressing thickening of ink in pressure chambers and nearby the discharge orifices, thereby suppressing defective discharge direction and non-discharge of ink, so high image quality recording can be performed as a result.

Description of Positional Relationship Among Recording Element Boards

Figure 12:
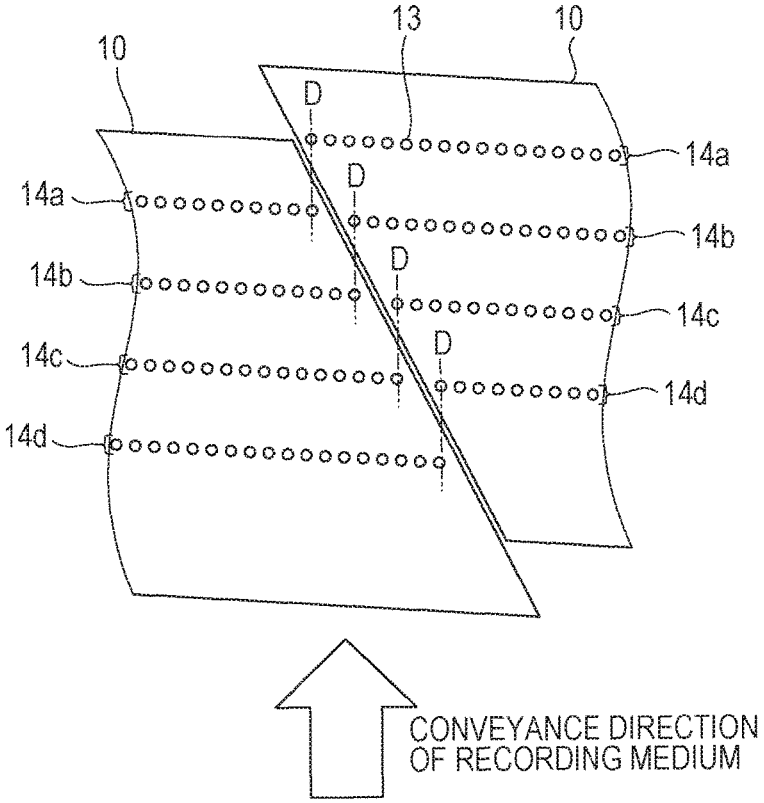
FIG. 12 is a plan view showing a partially enlarged illustration of adjacent portions of recording element boards in two adjacent discharge modules.

FIG. 12 is a plan view illustrating a partial enlargement of adjacent portions of recording element boards 10 for two adjacent discharge modules. The recording element boards 10 according to the present application example are shaped as general parallelograms, as illustrated in FIGS. 10A through 10C. The discharge orifice rows (14*a* through 14*d*) where discharge orifices 13 are arrayed on the recording element boards 10 are dispose inclined to the conveyance direction of the recording medium by a certain angle, as illustrated in FIG. 12. At least one discharge orifice of discharge orifice rows at adjacent portions of the recording element boards 10 is made to overlap in the conveyance direction of the recording medium thereby. In FIG. 12, two discharge orifices on the lines D are in a mutually overlapping relationship. This layout enables black streaks and blank portions in the recorded image to be made less conspicuous by driving control of the overlapping discharge orifices, even in a case where the positions of the recording element board 10 are somewhat deviated from the predetermined position. The multiple recording element boards 10 may be laid out in a straight line (inline) instead of in a staggered arrangement. In this case as well, black streaks and blank portions at connecting portions between the recording element boards 10 can be handled while suppressing increased length of the liquid discharge head 3 in the conveyance direction of the recording medium, due to a configuration such as illustrated in FIG. 12. Although the shape of the primary face of the recording element board 10 according to the present embodiment is a parallelogram, this is not restrictive. The configuration of the present invention can be suitably applied even in cases where the shape is a rectangle, a trapezoid, or another shape, for example.

Second Application Example

The configuration of an inkjet recording apparatus 1000 and liquid discharge head 3 according to a second application example to which the present invention can be applied will be described. Note that just portions that differ from the first application example will primarily be described below, and portions that are the same as the first application example will be omitted from description.

Description of Inkjet Recording Apparatus

Figure 13:
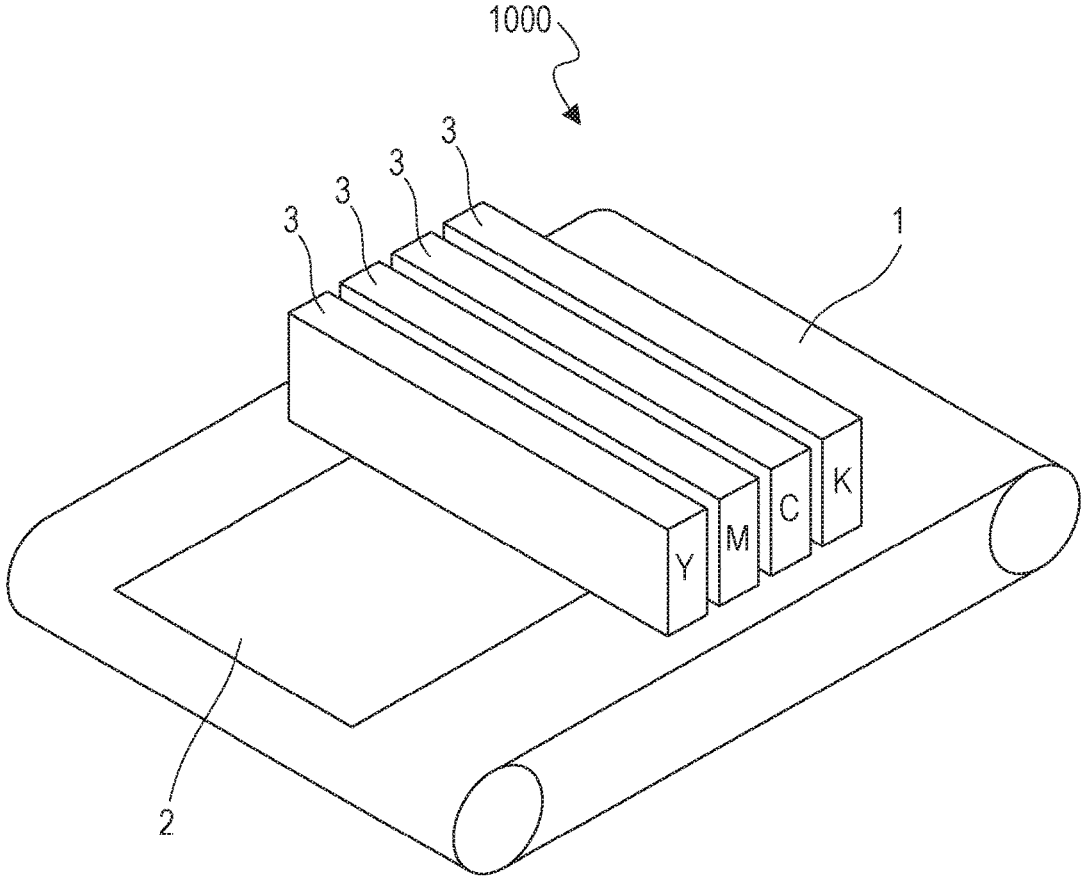
FIG. 13 is a diagram illustrating the configuration of the recording apparatus according to a second application example of the present invention.
Figure 19A:
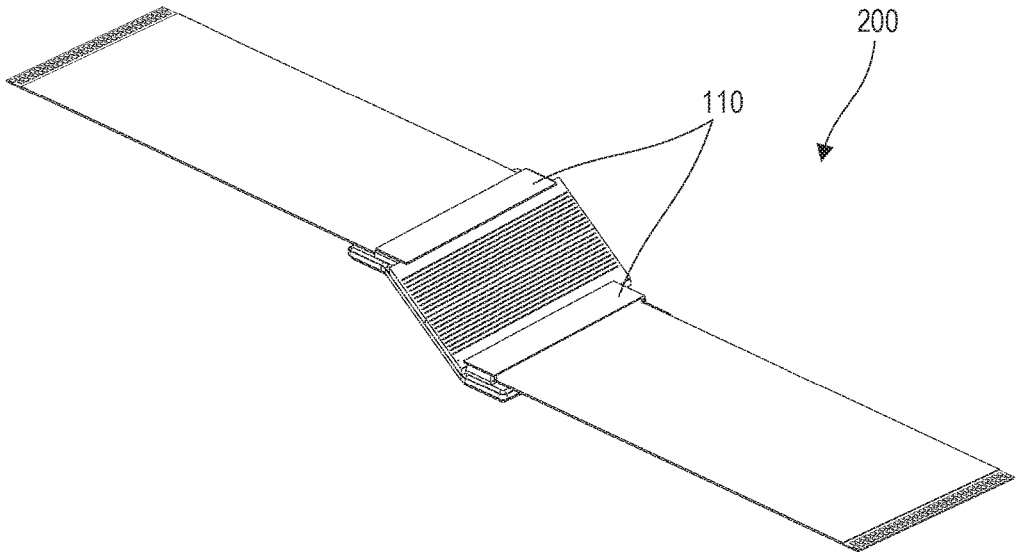
FIGS. 19A and 19B are diagrams illustrating a discharge module, FIG. 19A being a perspective view and FIG. 19B being a disassembled view.

FIG. 13 illustrates an inkjet recording apparatus according to the second application example of the present invention. The recording apparatus 1000 according to the second application example differs from the first application example with regard to the point that full-color recording is performed on the recording medium by arraying four monochrome liquid discharge heads 3, each corresponding to one of CMYK ink. Although the number of discharge orifice rows usable per color in the first application example was one row, the number of discharge orifice rows usable per color in the second application example is 20 rows (FIG. 19A). This enables extremely high-speed recording to be performed, by appropriately allocating recording data to multiple discharge orifice rows. Even if there are discharge orifices that exhibit ink non-discharge, reliability is improved by a discharge orifice at a corresponding position, in the conveyance direction of the recording medium as to the discharge orifice, in another row, performing discharge in a complementary manner, and accordingly the arrangement is suitable for industrial printing. The supply system of the recording apparatus 1000, the buffer tank 1003, and the main tank 1006 (FIG. 2) are connected to the liquid discharge heads 3 by fluid connection, in the same way as in the first application example. Each liquid discharge head 3 is also electrically connected to an electric control unit that transmits electric power and discharge control signals to the liquid discharge head 3.

Description of Circulation Paths

The first and second circulation paths illustrated in FIGS. 2 and 3 can be used as the liquid circulation paths between the recording apparatus 1000 and the liquid discharge heads 3, in the same way as in the first application example.

Description of Structure of Liquid Discharge Head

Figure 14A:
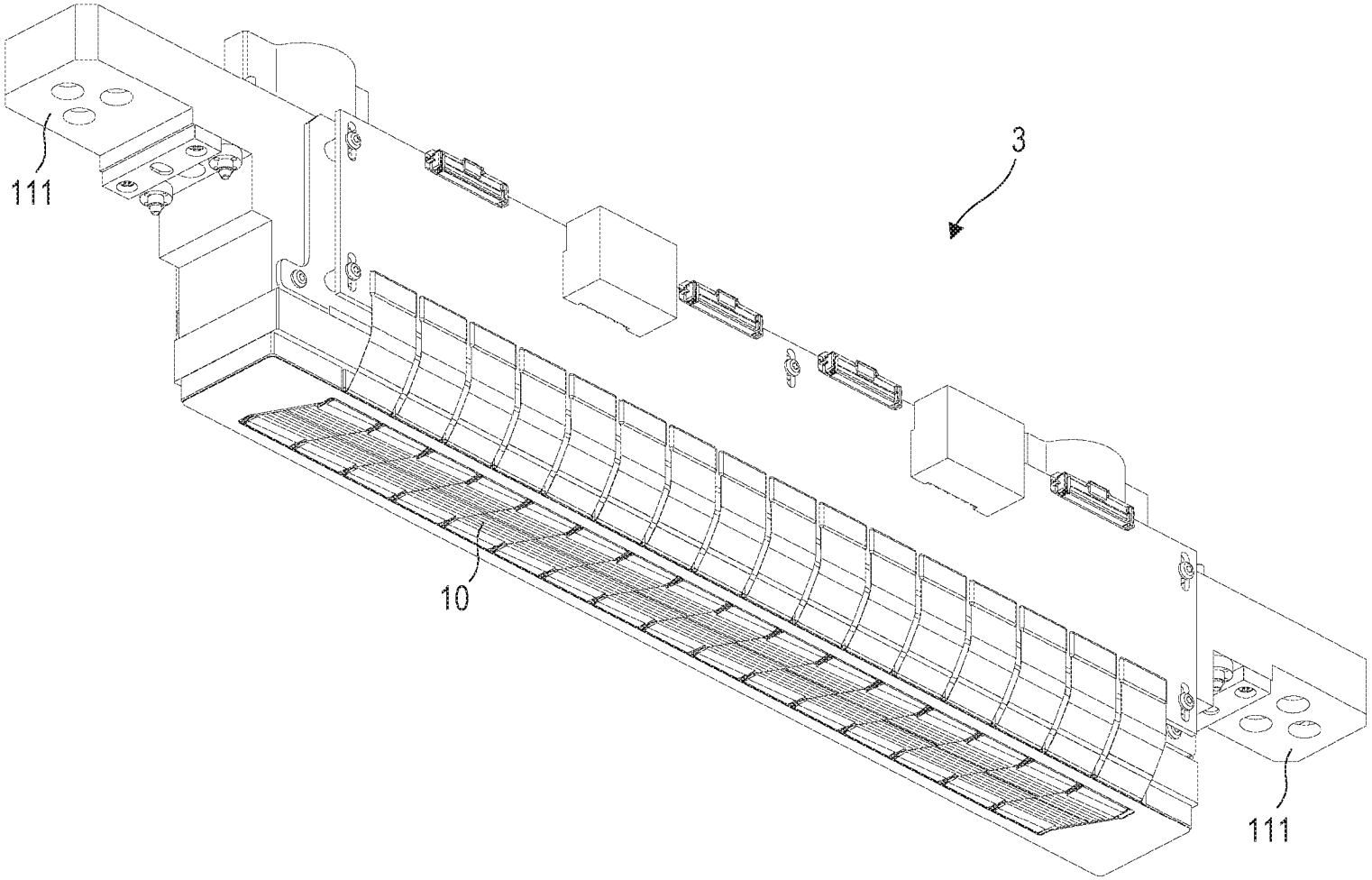
FIGS. 14A and 14B are perspective views of the liquid discharge head according to the second application example of the present invention.
Figure 14B:
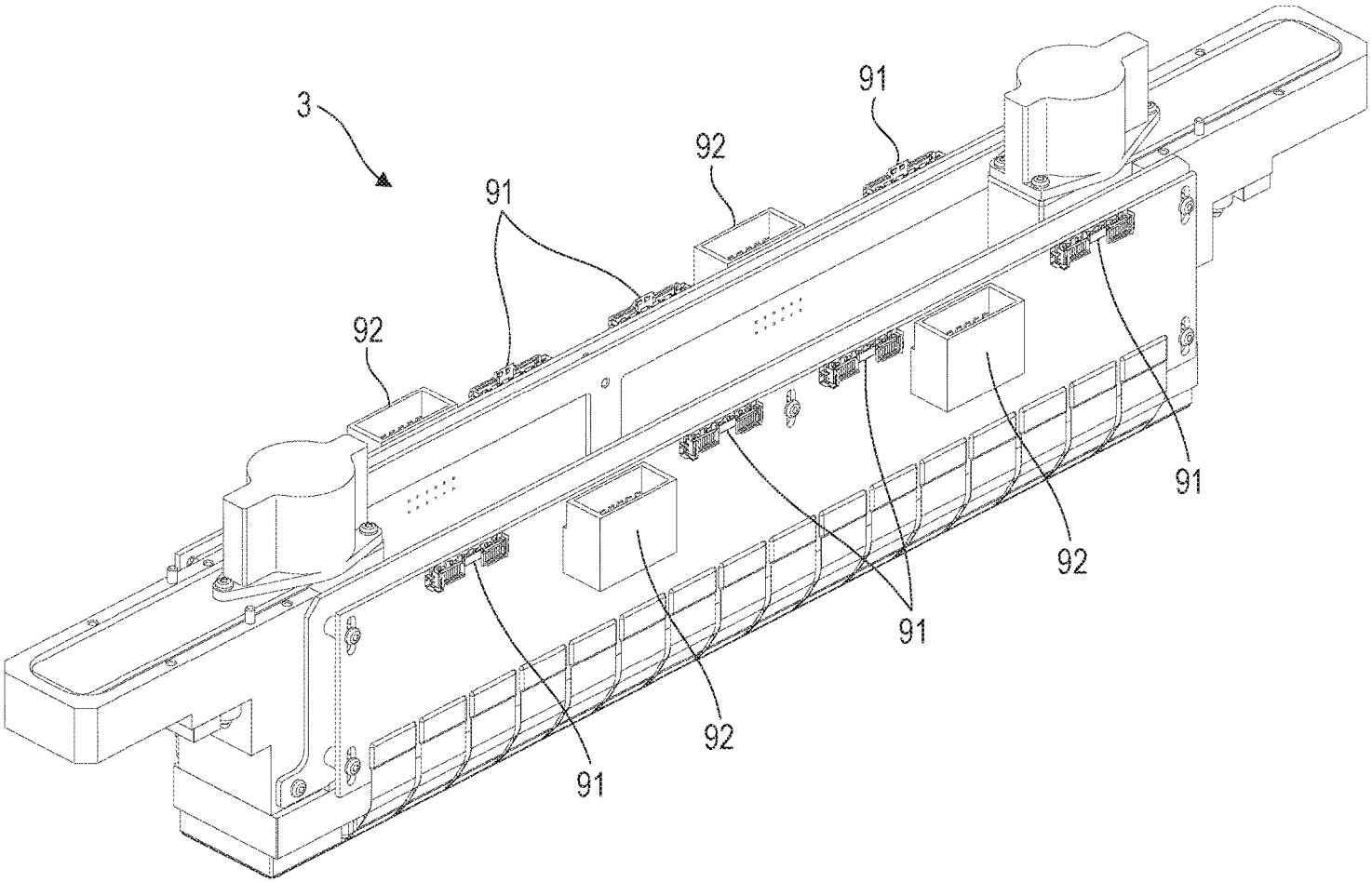

Description will be made regarding the structure of the liquid discharge head 3 according to the second application example of the present invention. FIGS. 14A and 14B are perspective diagrams of the liquid discharge head 3 according to the present application example. The liquid discharge head 3 has 16 recording element boards 10 arrayed in a straight line in the longitudinal direction of the liquid discharge head 3, and is an inkjet line recording head that can record with ink of one color. The liquid discharge head 3 has the liquid connection portions 111, signal input terminals 91, and power supply terminals 92 in the same way as the first application example. The liquid discharge head 3 according to the application example differs from the first application example in that the signal input terminals 91 and power supply terminals 92 are disposed on both sides of the liquid discharge head 3, since the number of discharge orifice rows is greater. This is to reduce voltage drop and signal transmission delay that occurs at wiring portions provided to the recording element boards 10.

Figure 15:
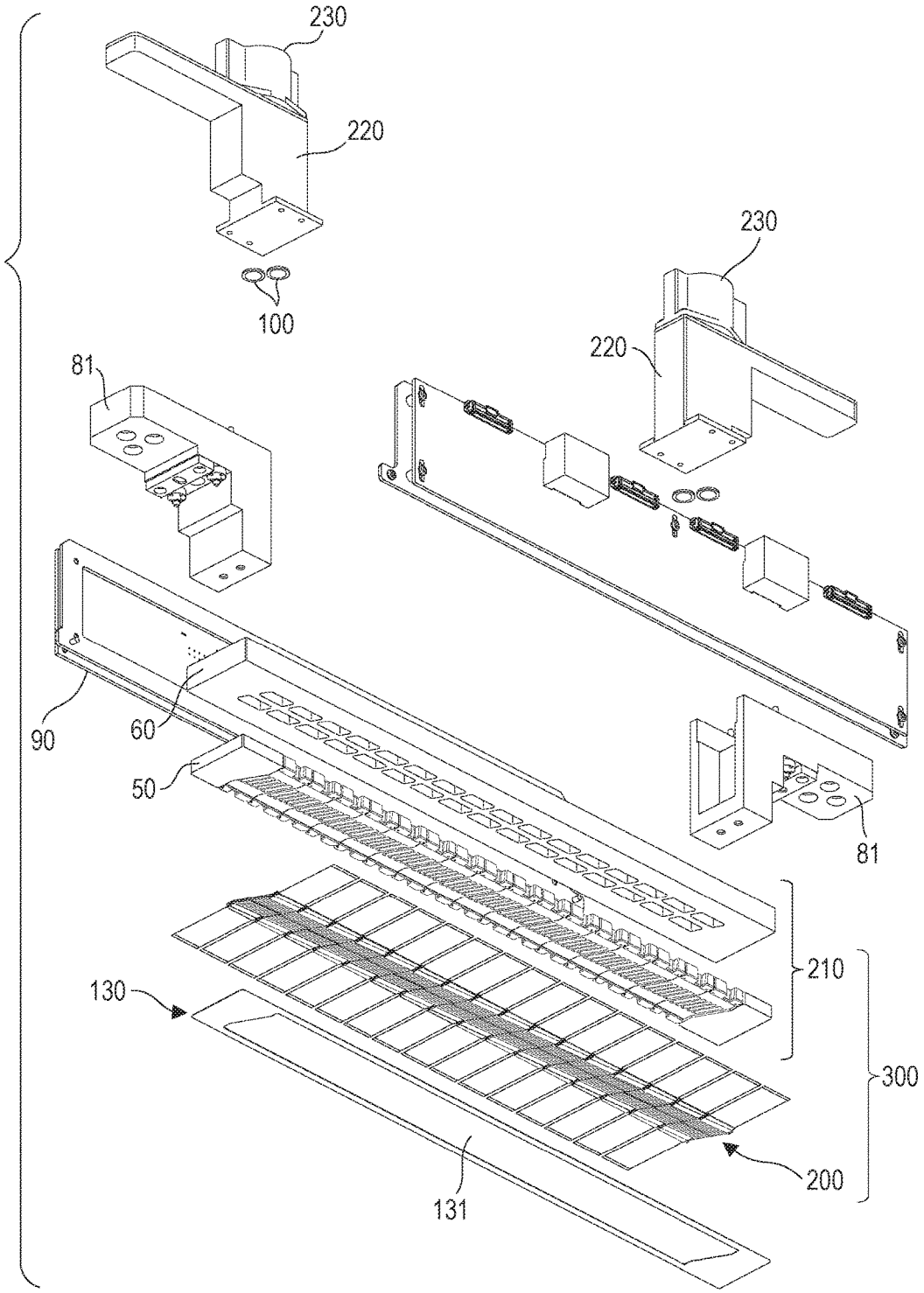
FIG. 15 is a disassembled perspective view of the liquid discharge head in FIG. 14.

FIG. 15 is a disassembled perspective view of the liquid discharge head 3, illustrating each part or unit making up the liquid discharge head 3 disassembled according to function. The roles of the units and members, and the order of liquid flow through the liquid discharge head, are basically the same as in the first application example, but the function by which the rigidity of the liquid discharge head is guaranteed is different. The rigidity of the liquid discharge head was primarily guaranteed in the first application example by the liquid discharge unit support member 81, but the rigidity of the liquid discharge head is guaranteed in the second application example by the second channel member 60 included in the liquid discharge unit 300. There are liquid discharge unit support members 81 connected to both ends of the second channel member 60 in the present application example. This liquid discharge unit 300 is mechanically enjoined to a carriage of the recording apparatus 1000, whereby the liquid discharge head 3 is positioned. Liquid supply units 220 having negative pressure control units 230, and the electric wiring board 90, are joined to the liquid discharge unit support members 81. Filters (omitted from illustration) are built into the two liquid supply units 220. The two negative pressure control units 230 are set to control pressure by high and low negative pressure that relatively differ from each other. When the high-pressure side and low-pressure side negative pressure control units 230 are disposed on the ends of the liquid discharge head 3 as illustrated in FIGS. 14A through 15, the flow of ink on the common supply channel 211 and the common recovery channel 212 that extend in the longitudinal direction of the liquid discharge head 3 are mutually opposite. This promotes heat exchange between the common supply channel 211 and common recovery channel 212, so that the temperature difference between the two common channels can be reduced. This is advantageous in that temperature difference does not readily occur among the multiple recording element boards 10 disposed along the common channels, and accordingly unevenness in recording due to temperature difference does not readily occur.

The channel member 210 of the liquid discharge unit 300 will be described in detail next. The channel member 210 is the first channel member 50 and second channel member 60 that have been laminated as illustrated in FIG. 15, and distributes ink supplied from the liquid supply unit 220 to the discharge modules 200. The channel member 210 also serves as a channel member for returning ink recirculating from the discharge modules 200 to the liquid supply unit 220. The second channel member 60 of the channel member 210 is a channel member in which the common supply channel 211 and common recovery channel 212 have been formed, and also primary undertakes the rigidity of the liquid discharge head 3. Accordingly, the material of the second channel member 60 preferably is sufficiently corrosion-resistant as to the ink and has high mechanical strength. Specific examples of suitably-used materials include stainless steel, titanium (Ti), alumina, or the like.

Figure 16A:
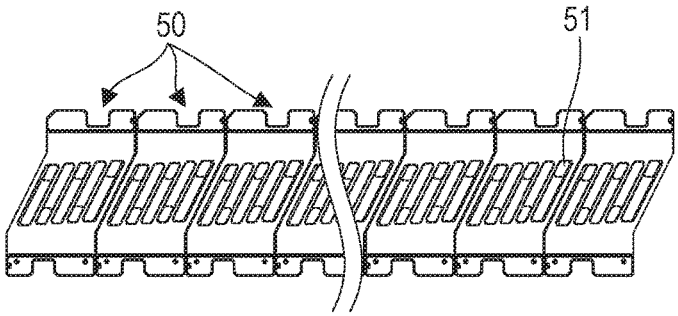
FIGS. 16A through 16E are diagrams illustrating the configuration of first and second channel members making up the channel member that the liquid discharge head in FIG. 14 has.
Figure 16B:
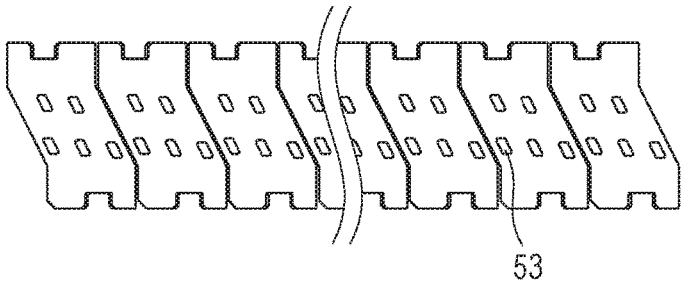
Figure 16C:
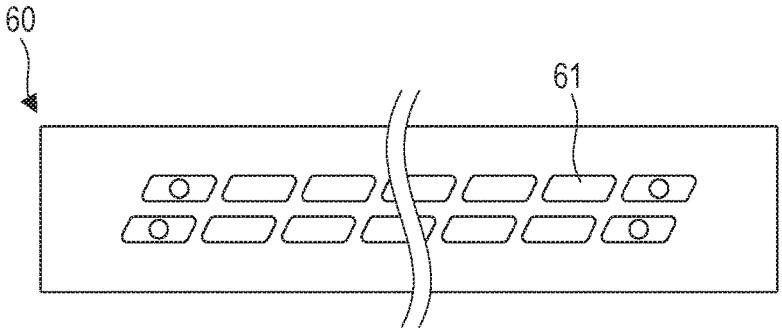
Figure 16D:
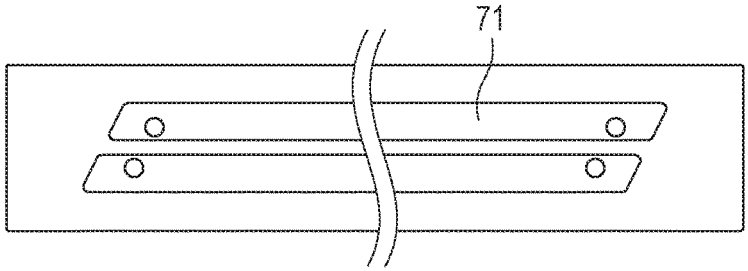
Figure 16E:
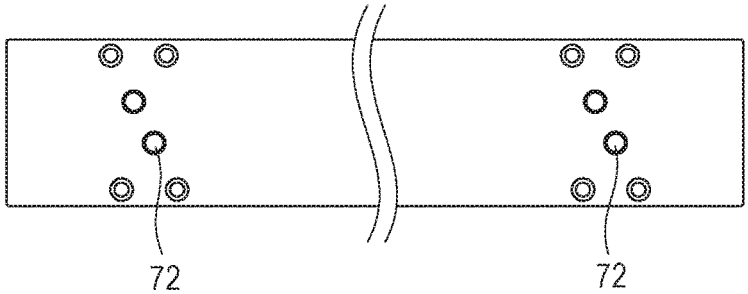

FIG. 16A illustrates the face of the first channel member 50 on the side where the discharge modules 200 are mounted, and FIG. 16B is a diagram illustrating the reverse face therefrom, that comes into contact with the second channel member 60. Unlike the case in the first application example, the first channel member 50 according to the second application example is an arrangement where multiple members corresponding to the discharge modules 200 are arrayed adjacently. Using this divided structure enables a length corresponding to the length of the liquid discharge head to be realized by arraying multiple modules, and accordingly can particularly be suitably used in relatively long-scale liquid discharge heads corresponding to sheets of B2 size and even larger, for example. The communication ports 51 of the first channel member 50 communicate with the discharge modules 200 by fluid connection as illustrated in FIG. 16A, and individual communication ports 53 of the first channel member 50 communicate with the communication ports 61 of the second channel member 60 by fluid connection, as illustrated in FIG. 16B. FIG. 16C illustrates the face of the second channel member 60 that comes in contact with the first channel member 50, FIG. 16D illustrates a cross-section of the middle portion of the second channel member 60 taken in the thickness direction, and FIG. 16E is a diagram illustrating the face of the second channel member 60 that comes into contact with the liquid supply unit 220. The functions of the channels and communication ports of the second channel member 60 are the same as in with one color worth in the first application example. One of the common channel grooves 71 of the second channel member 60 is the common supply channel 211 illustrated in FIG. 17, and the other is the common recovery channel 212. Both have ink supplied from one end side toward the other end side following the longitudinal direction of the liquid discharge head 3. Unlike the case in the first application example, the flow directions of ink for the common supply channel 211 and common recovery channel 212 are mutually opposite directions in the present embodiment.

Figure 17:
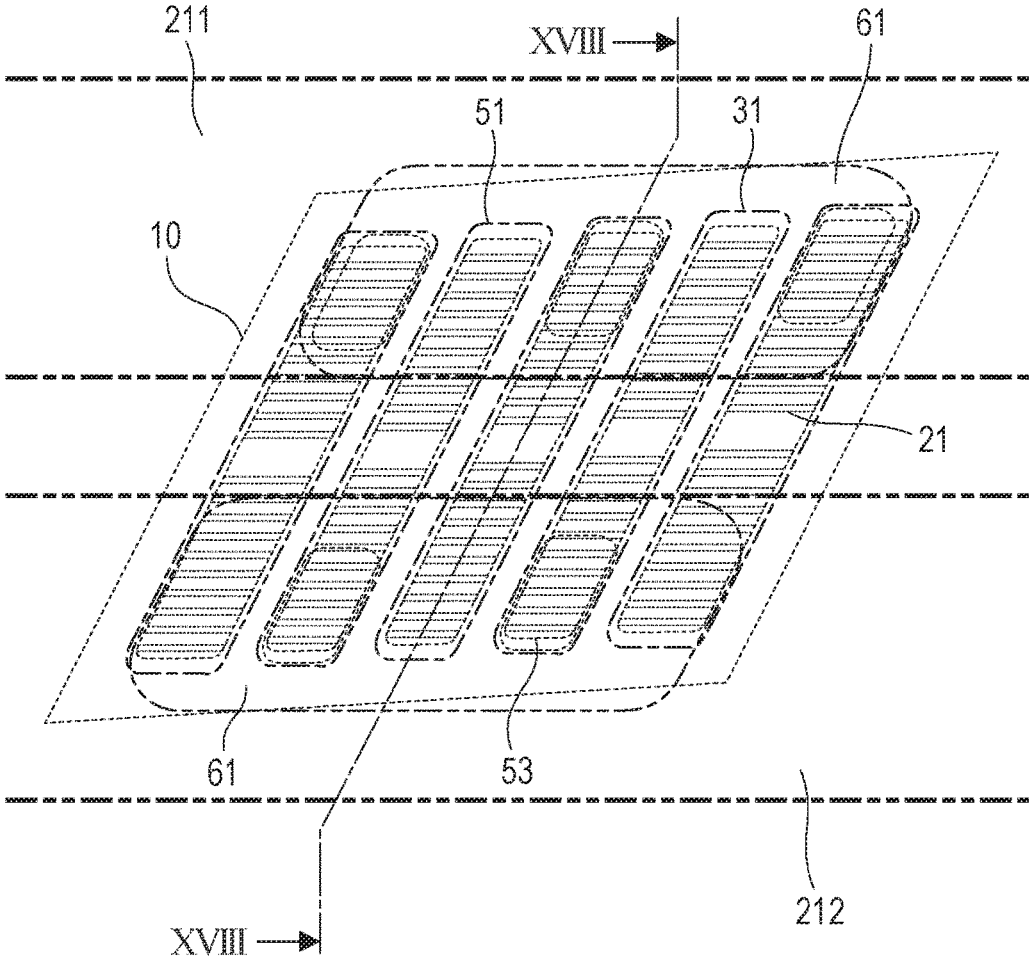
FIG. 17 is a diagram for describing connection relationships of liquid in the recording element board and channel member.

FIG. 17 is a transparent view illustrating the connection relationship regarding ink between the recording element boards 10 and the channel member 210. The set of the common supply channel 211 and common recovery channel 212 extending in the longitudinal direction of the liquid discharge head 3 is provided within the channel member 210, as illustrated in FIG. 17. The communication ports 61 of the second channel member 60 are each positioned with and connected to the individual communication ports 53 of the first channel member 50, thereby forming a liquid supply path from the communication ports 72 of the second channel member 60 to the communication ports 51 of the first channel member 50 via the common supply channel 211. In the same way, a liquid supply path from the communication ports 72 of the second channel member 60 to the communication ports 51 of the first channel member 50 via the common recovery channel 212 is also formed.

Figure 18:
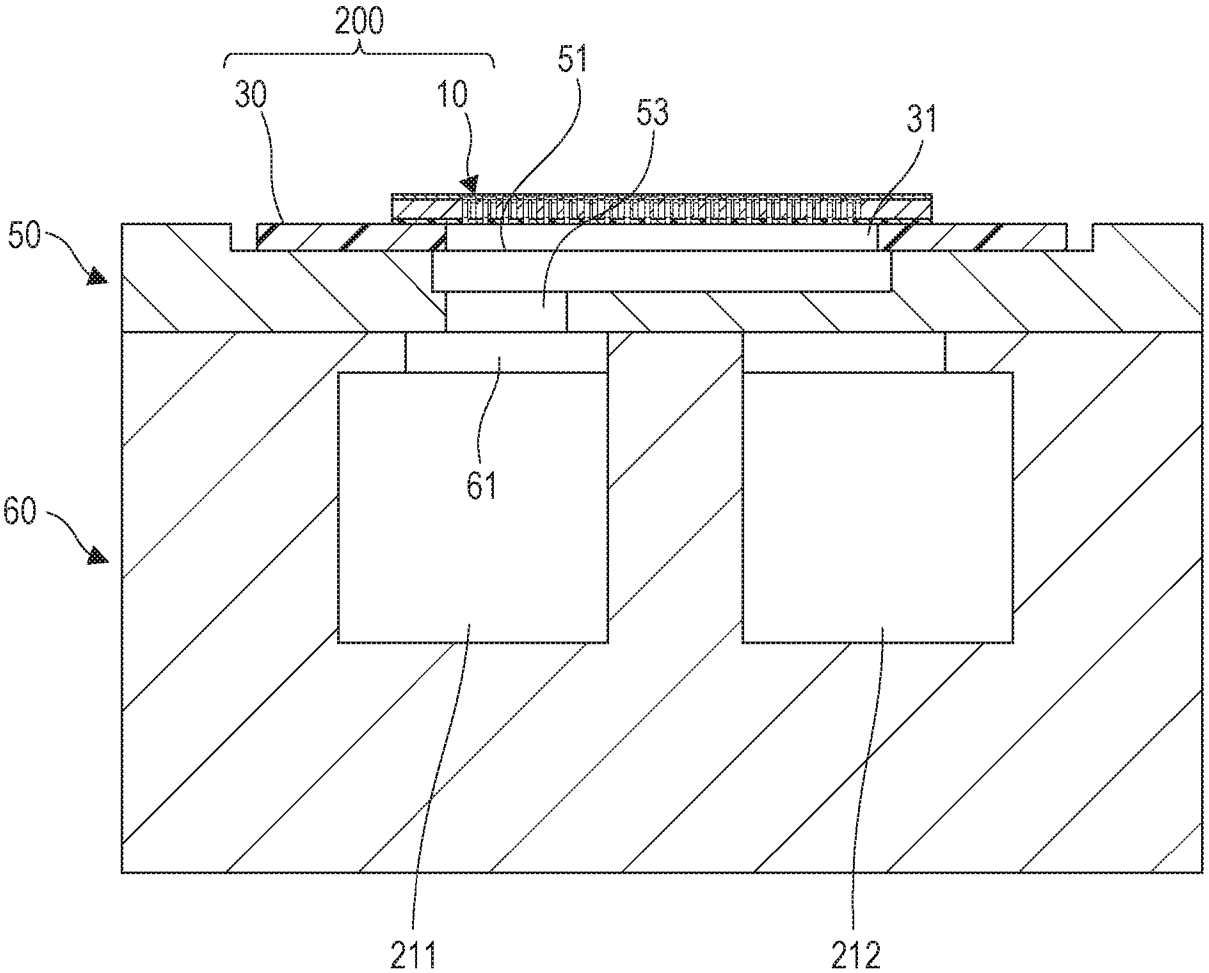
FIG. 18 is a cross-sectional view taken along line XVIII-XVIII in FIG. 17.

FIG. 18 is a diagram illustrating a cross-section taken along XVIII-XVIII in FIG. 17. FIG. 18 shows how the common supply channel 211 connects to the discharge module 200 through the communication port 61, individual communication port 53, and communication port 51. Although omitted from illustration in FIG. 18, it can be clearly seen from FIG. 17 that another cross-section would show an individual recovery channel 214 connected to the discharge module 200 through a similar path. Channels are formed on the discharge modules 200 and recording element boards 10 to communicate with the discharge orifices 13, and part or all of the supplied ink recirculates through the discharge orifices 13 (pressure chambers 23) that are not performing discharging operations, in the same way as in the first application example. The common supply channel 211 is connected to the negative pressure control unit 230 (high-pressure side), and the common recovery channel 212 to the negative pressure control unit 230 (low-pressure side), via the liquid supply unit 220, in the same way as in the first application example. Accordingly, a flow is generated by the differential pressure thereof, that flows from the common supply channel 211 through the discharge orifices 13 (pressure chambers 23) of the recording element board 10 to the common recovery channel 212.

Description of Discharge Module

Figure 19B:
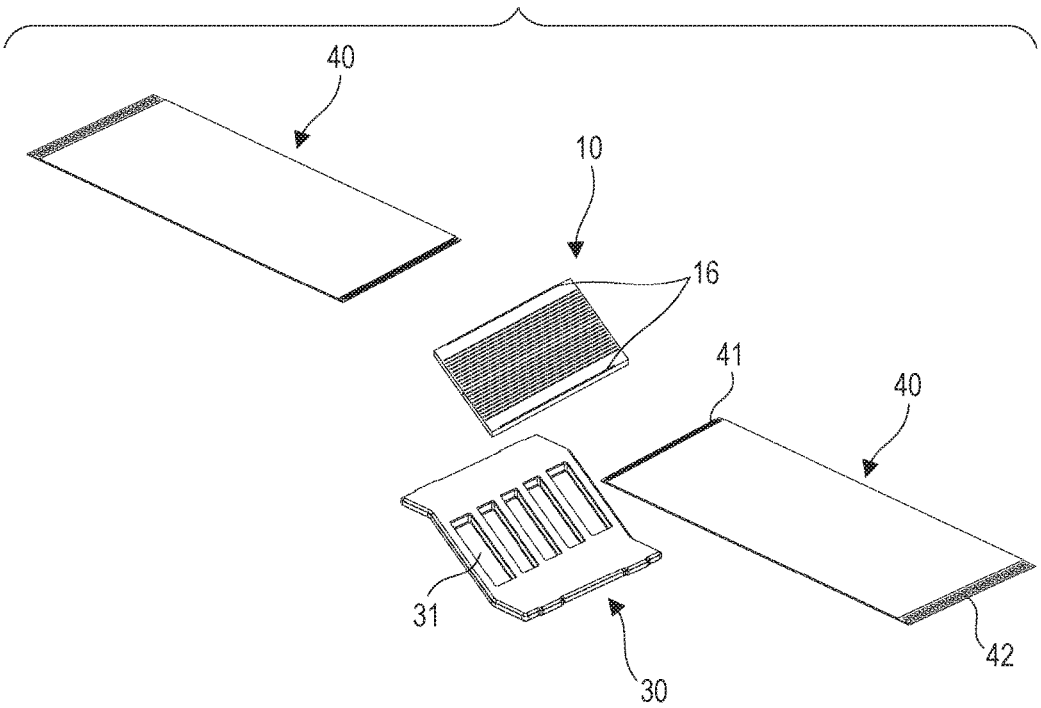

FIG. 19A is a perspective view of one discharge module 200, and FIG. 19B is a disassembled view thereof. Unlike the first application example, multiple terminals 16 are disposed arrayed on both sides (the long side portions of the recording element board 10) following the direction of the multiple discharge orifice rows of the recording element board 10, and two flexible printed circuit boards 40 are provided to one recording element board 10 and are electrically connected to the terminals 16. The reason is that the number of discharge orifice rows provided on the recording element board 10 is 20 rows, which is a great increase over the eight rows in the first application example. The object thereof is to keep the maximum distance from the terminals 16 to the recording elements 15 provided corresponding to the discharge orifice row short, hereby reducing voltage drop and signal transmission delay that occurs at wiring portions provided to the recording element board 10. Liquid communication ports 31 of the support member 30 are provided to the recording element board 10, and are opened so as to span all discharge orifice rows. Other points are the same as in the first application example.

Description of Structure of Recording Element Board

Figure 20A:
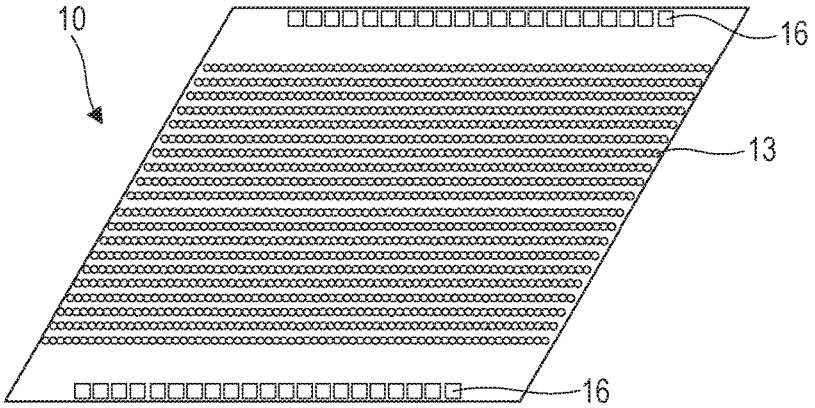
FIGS. 20A through 20C are diagrams illustrating the configuration of the recording element board.
Figure 20B:
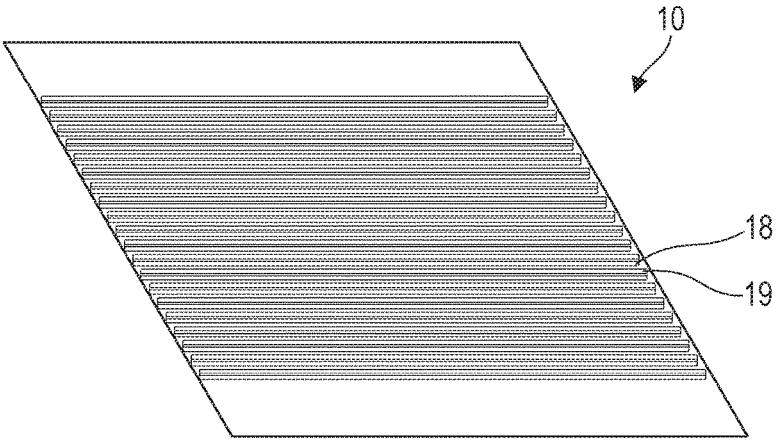
Figure 20C:
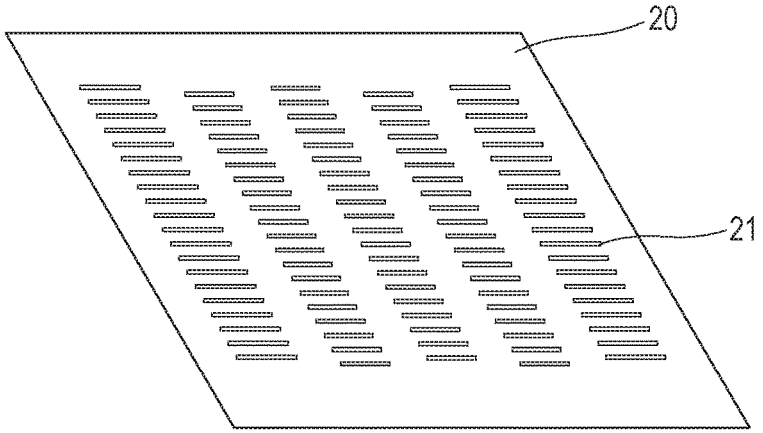

FIG. 20A is a schematic diagram illustrating the face of the recording element board 10 on the side where the discharge orifices 13 are disposed, and FIG. 20C is a schematic diagram illustrating the reverse face of that illustrated in FIG. 20A. FIG. 20B is a schematic diagram illustrating the face of the recording element board 10 in a case where the cover 20 provided on the rear face side of the recording element board 10 is removed in FIG. 20C. Liquid supply channels 18 and liquid recovery channels 19 are alternately provided on the rear face of the recording element board 10 following the discharge orifice row direction, as illustrated in FIG. 20B. Despite the number of discharge orifice rows being much greater than that in the first application example, a substantial difference from the first application example is that the terminals 16 are disposed on both side portions of the recording element board 10 following the discharge orifice row direction, as described above. The basic configuration is the same as that in the first application example, such as one set of a liquid supply channel 18 and liquid recovery channel 19 being provided for each discharge orifice row, openings 21 that communicate with the liquid communication ports 31 of the support member 30 being provided to the cover 20, and so forth.

First Embodiment

Figure 21A:
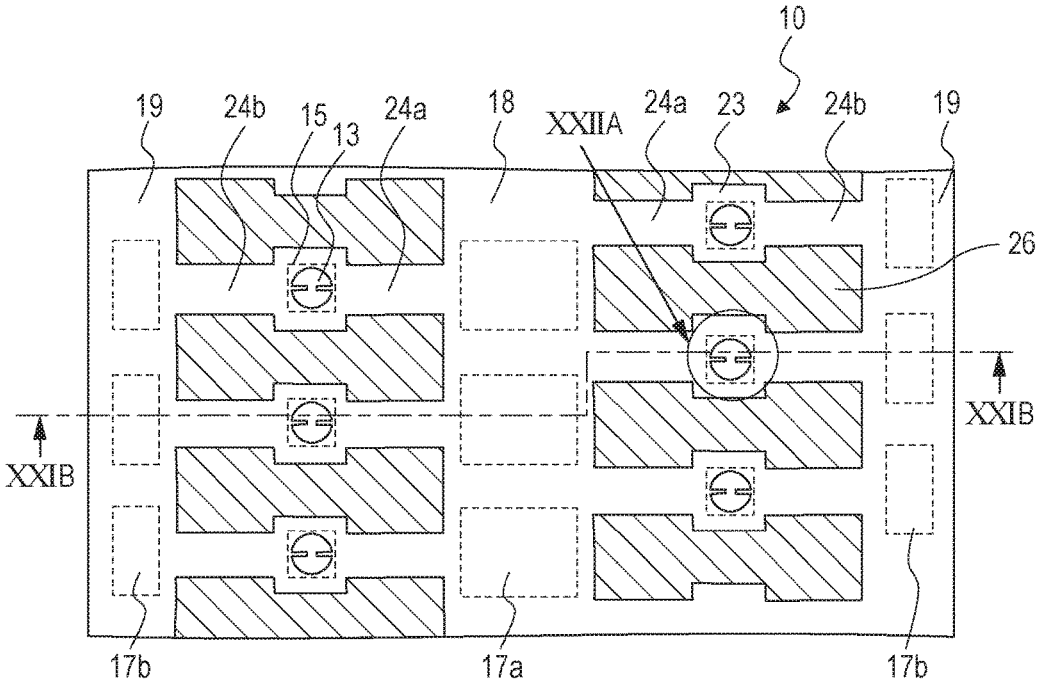
FIGS. 21A and 21B are conceptual diagrams illustrating the inside of a liquid discharge head according to a first embodiment.
Figure 21B:
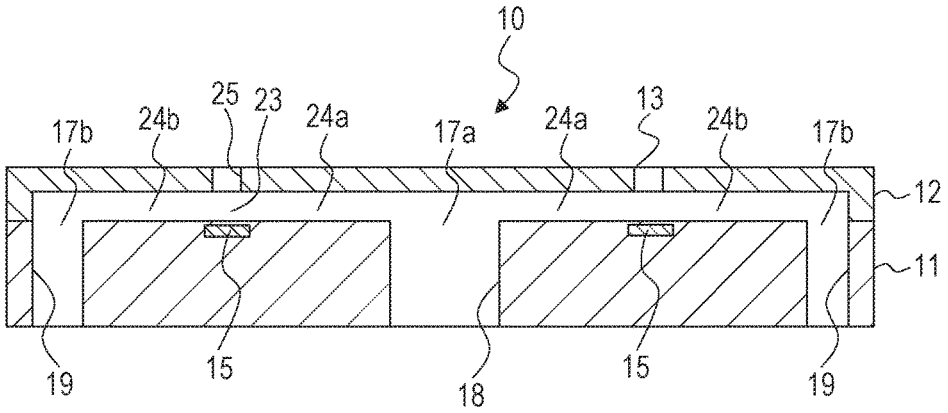

Relationship Between Reduction in Tail Length and Dimensions of Discharge Orifice FIGS. 21A and 21B illustrate the inside of a liquid discharge head. FIG. 21A is a plan view of recording elements 15 and channels, and FIG. 21B is a cross-sectional view taken along line XXIB-XXIB in FIG. 21A. Provided between the substrate 11 and discharge orifice forming member 12 of the recording element board 10 are multiple pressure chambers 23 each having a discharge orifice 13, and an inlet channel 24*a* and an outlet channel 24*b* communicating with each pressure chamber 23. The pressure chambers 23 are partitioned by wall members 26. A liquid supply channel 18 communicating with the inlet channels 24*a*, and liquid recovery channels 19 communicating with the outlet channels 24*b*, are provided to the substrate 11. The inlet channels 24*a* branch from the liquid supply channel 18 at supply ports 17*a* of the liquid supply channel 18 and communicate with the pressure chambers 23, supplying ink to the pressure chambers 23. The outlet channels 24*b* communicate with the pressure chambers 23 on the opposite side of the pressure chambers 23 from the inlet channels 24*a*, and pass ink not discharged from the discharge orifices 13 to the liquid recovery channel 19 via recovery ports 17*b* of the liquid recovery channel 19.

The multiple supply ports 17*a* form a supply port row, and the multiple recovery ports 17*b* form recovery port rows. A discharge orifice row where multiple discharge orifices 13 are arrayed is formed between the supply port row and recovery port row. Discharge orifice rows and recovery port rows are provided on both sides of the supply port row in the present embodiment. A pressure difference is provided between the liquid supply channel 18 and liquid recovery channels 19, as described earlier. This pressure difference generates a flow where ink is guided into the pressure chamber 23 from the supply port 17*a* through the inlet channel 24*a*, and from the outlet channel 24*b* to the recovery port 17*b*. That is to say, ink passes through the liquid supply channel 18, supply port 17*a*, and inlet channel 24*a* into the pressure chamber 23, and is discharged from the discharge orifices 13. Ink that was not discharged is recovered through the outlet channel 24*b*, recovery port 17*b*, and liquid recovery channel 19. The recovered ink is supplied to the liquid supply channel 18 again through circulation channels omitted from illustration.

The recording element 15 that generates thermal energy is disposed on the bottom face of the pressure chamber 23, facing the discharge orifice 13. A discharge orifice portion (nozzle) 25 passes through the discharge orifice forming member 12 at a position facing the pressure chamber 23. The discharge orifice 13 that discharges ink is formed at the outer end of the discharge orifice portion 25, i.e., at the end thereof opposite from the recording element 15. The discharge orifice portion 25 and discharge orifice 13 are provided at positions facing the recording element 15. The discharge orifice 13 in the present specification is the opening situated at the outer face of the discharge orifice forming member 12 facing the recording medium, while the discharge orifice portion 25 is a portion by which the discharge orifice 13 and pressure chamber 23 communicate, serving as a through hole passing through the discharge orifice forming member 12.

Figure 22A:
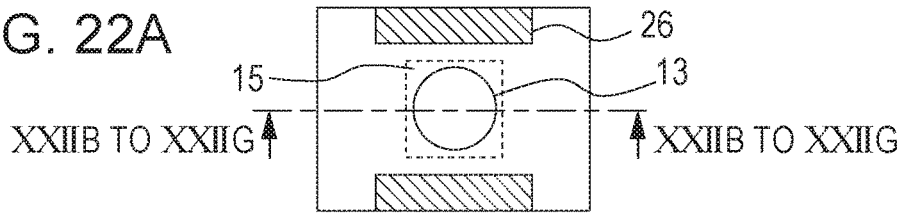
FIGS. 22A through 22G are schematic diagrams illustrating a transient process of a discharge phenomenon.
Figure 22B:
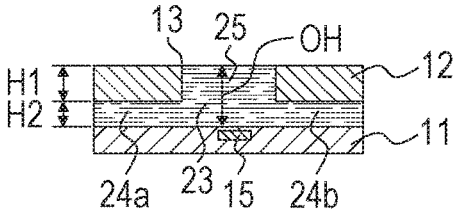
Figure 22C:
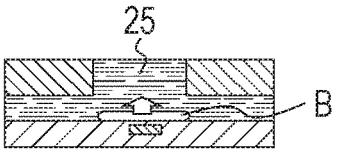
Figure 22D:
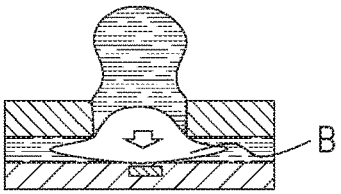
Figure 22E:
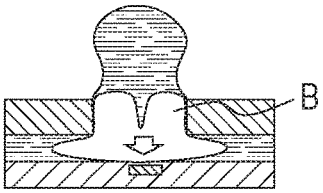
Figure 22F:
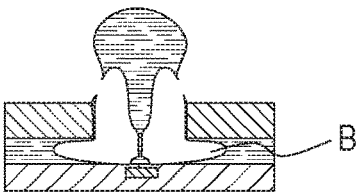
Figure 22G:
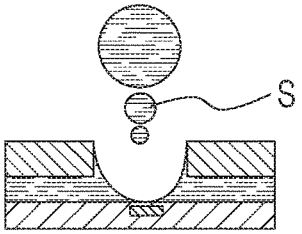

FIGS. 22A through 22G are schematic diagrams illustrating a transient process of the discharge phenomenon. FIG. 22A is an enlarged view of XXIIB in FIG. 21A, and FIGS. 22B through 22G are cross-sectional diagrams taken along line XXIIB to XXIIG-XXIIB to XXIIG in FIG. 22A. The protrusions of the discharge orifices 13 illustrated in FIG. 21A are omitted from FIGS. 22A through 22G. Ink is supplied to the pressure chamber 23 from the inlet channel 24*a* (see FIG. 22B). The recording element 15 generates thermal energy used for discharging liquid, by electric energy being applied thereto. The ink near the recording element 15 is heated and evaporated by this thermal energy, forming a bubble B (see FIG. 22C). The pressure of the bubble B at the initial stage of generation is extremely high, and the bubble B pushes ink between the bubble B and the discharge orifice 13 toward the discharge orifice 13 (see the arrow in FIG. 22C). The bubble B enters inside the discharge orifice portion 25 while continuing to grow. The internal pressure of the bubble B rapidly changes from a positive pressure to a negative pressure lower than the atmospheric pressure due to the growth thereof (see FIG. 22D). This negative pressure draws the trailing end of the droplet back to the recording element 15 side, forming an extended tail (see FIG. 22E). As the bubble B further advances through the discharge orifice portion 25, the bubble B communicates with the atmosphere, either inside or outside the discharge orifice portion 25. As a result, the negative pressure of the bubble B is suddenly lost, and growth of the tail length also stops (see FIG. 22F). Ink between the generated bubble B and the discharge orifice 13 is thus discharged from the discharge orifice 13 by pressure of the bubble B through the above-described process. The discharged ink is primarily discharged as the main droplet, but satellites S and mist also occur behind the main droplet (see FIG. 22G). In the present embodiment, the bubble B communicates with the atmosphere in a state where the internal pressure is negative pressure, and the volume increases (expands). Thus, the discharge volume of the droplet stabilizes, and discharge speed is faster. In a configuration where protrusions 27 are provided to the discharge orifice 13 as in the present embodiment, the area of the discharge orifice is smaller, so the discharge speed generally tends to fall. However, causing the bubble B to communicate with the atmosphere while growing to discharge the droplet enables occurrence of satellites to be suppressed while suppressing drop in discharge speed.

Figure 23A:
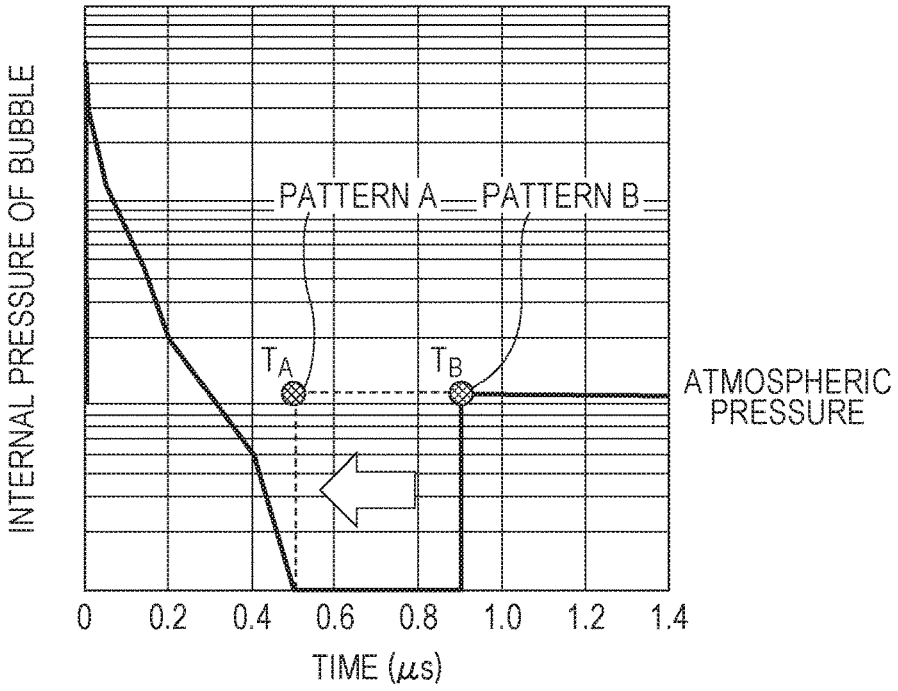
FIGS. 23A through 23C are diagrams illustrating the relationship between a pressure profile of inside of a bubble, and internal pressure of a bubble.
Figure 23B:
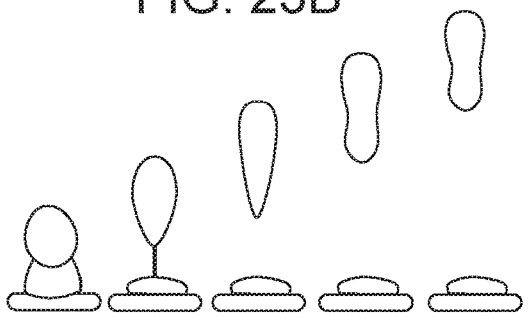
Figure 23C:
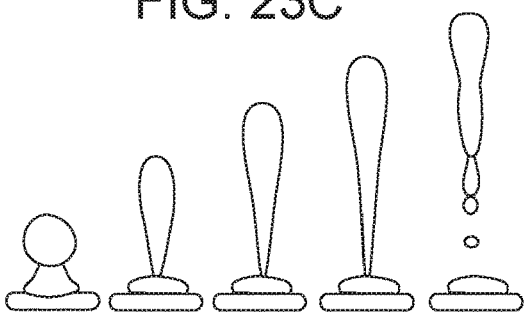

FIG. 23A illustrates the relationship between a pressure profile inside a bubble and internal pressure within the bubble. The horizontal axis represents time, and the vertical axis represent internal pressure. FIG. 23A illustrates pattern A and pattern B, where the discharge orifice dimensions are the same and just the pressure profiles inside the bubble differ. FIG. 23B schematically illustrates the way in which ink is discharged according to pattern A, and FIG. 23C the way in which ink is discharged according to pattern B. Both pattern A and pattern B exhibit a rapid rise in internal pressure of the bubble, followed by a turn to negative pressure, and subsequently a rise to atmospheric pressure when the bubble communicates with the atmosphere. In pattern B, the bubble communicates with the atmosphere at time $T_B$, so the amount of time over which the internal pressure within the bubble is maintained at a negative pressure is long. It can be seen from FIG. 23C that the tail of the droplet is longer as compared with pattern A, and satellites readily form. The bubble in pattern A communicates with the atmosphere at a time $T_A$ that is earlier than $T_B$, so the amount of time over which the internal pressure within the bubble is maintained at a negative pressure is short. Accordingly, the tail is relatively shorter, and occurrence of satellites is suppressed, as illustrated in FIG. 23B. Accordingly, reducing the amount of time of negative pressure and communicating the bubble with the atmosphere at an early point is effective in suppressing the tail from becoming elongated, and consequently is effective in suppressing satellites.

Figure 24A:
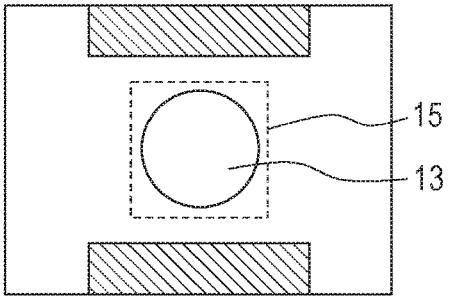
FIGS. 24A through 24D are diagrams illustrating the relationship between the distance from a recording element to a discharge orifice, and an atmospheric communication time.
Figure 24B:
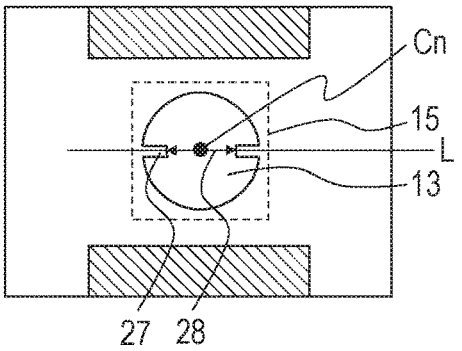
Figure 24C:
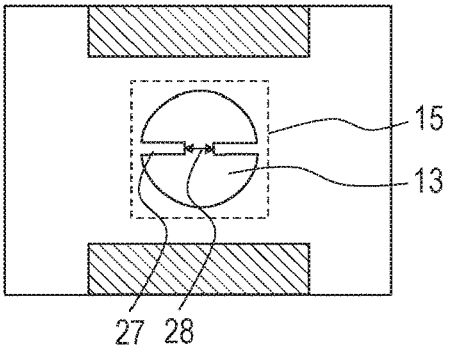
Figure 24D:
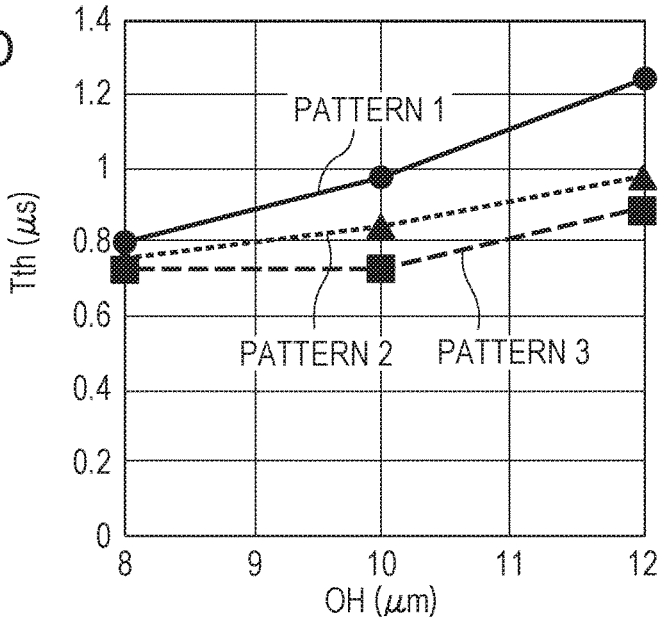

FIGS. 24A through 24D illustrate the relationship between a distance OH from the recording element 15 to the discharge orifice 13 (FIG. 22B) and the amount of time from the recording element 15 starting to be heated until the bubble communicates with the atmosphere (hereinafter referred to as "atmospheric communication time Tth"). The distance OH is equal to the sum of a height H1 of the discharge orifice forming member 12 that is also the height of the discharge orifice portion 25, and a height H2 of the inlet channel 24*a* in a direction perpendicular to the bottom face of the pressure chamber 23 where the recording element 15 is disposed, i.e., OH=H1+H2 (see FIG. 22B). Three patterns are considered here for the shape of the discharge orifice, a pattern 1 that has a circular shape (FIG. 24A), and patterns 2 and 3 having two protrusions 27 protruding toward the center of the discharge orifice 13 (FIGS. 24B and 24C). The two protrusions 27 in patterns 2 and 3 are situated on a straight line L passing through the center Cn of the discharge orifice 13, and are provided on both sides across the center Cn and have the same shape. The protrusions 27 are formed longer in pattern 3 than in pattern 2, and a gap 28 between the protrusions 27 is smaller.

In either pattern, the OH and the effective diameter of the discharge orifice 13 is the same, OH being 12 μm or smaller, and the effective diameter of the discharge orifice 13 being 11 μm or larger (opening area≥100 $\mu m^2$). The effective diameter is defined as the diameter of a circle having an area equal to the actual area of the discharge orifice 13. Note that the opening area of the discharge orifice 13 preferably is 100 $\mu m^2$ or larger. In a case where the discharge orifice 13 is circular in shape (pattern 1), it can be seen that the OH needs to be reduced to reduce the Tth in order to shorten the tail. The discharge orifice forming member 12 needs to be formed thinner (reducing H1) or the height of the inlet channel 24*a* lowered (reducing H2) in order to reduce the OH. Both are problematic, in that the former results in a discharge orifice forming member 12 that is easier to crack or the like, and reliability may fall. The latter gives concern that throughput may deteriorate due to increased flow resistance.

On the other hand, in a case where the protrusions 27 are provided to the discharge orifice 13 (patterns 2 and 3), the Tth is lower in comparison with pattern 1. Particularly, reduction in Tth is marked in the case where the gap between the protrusions 27 is narrow (pattern 3). This leads to a shorter tail, and occurrence of satellites is suppressed. Although description has been made here regarding a configuration where two protrusions 27 are provided in the present embodiment, this is not restrictive, and the present invention is applicable to cases where one protrusion or three or more protrusions are provided, which will be described later. In these cases as well, a narrower gap between the protrusions 27 (between the tip of the protrusion and the edge of the discharge orifice in the case of one protrusion) is preferable since this leads to a shorter tail, in the same way as in the case of two protrusions 27.

Figure 25:
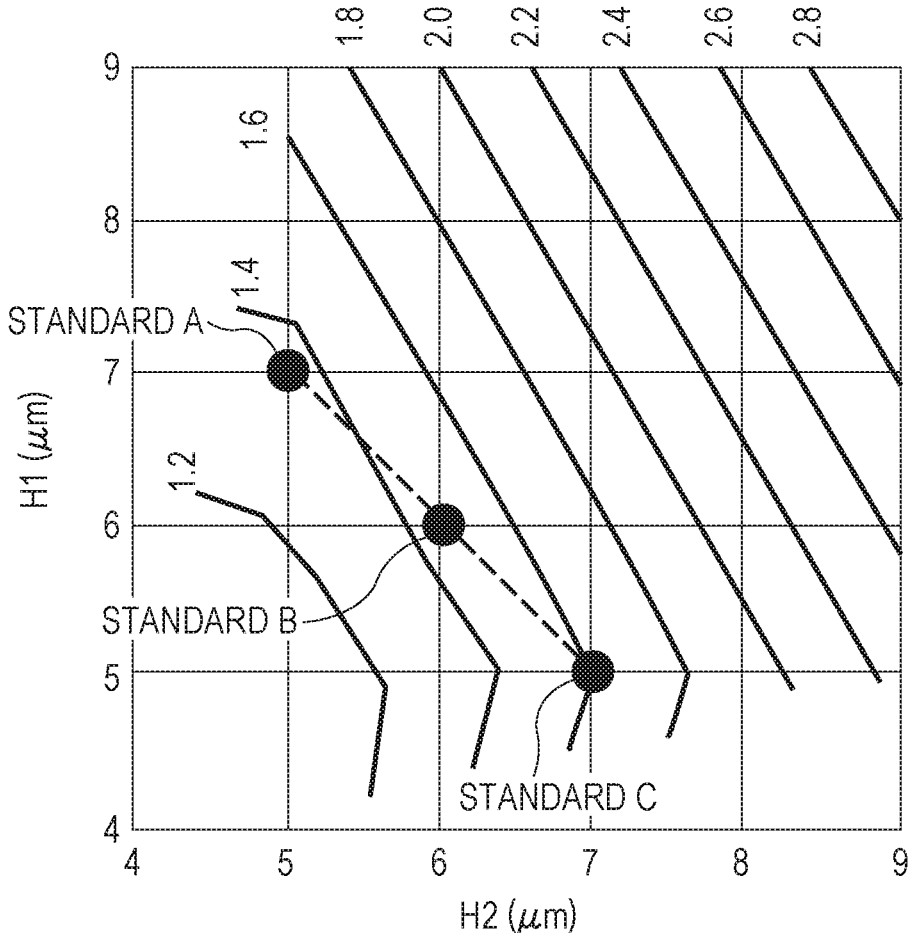
FIG. 25 is a diagram illustrating the relationship among the thickness of a discharge orifice forming member, the height of an inlet channel, and atmospheric communication time.

FIG. 25 illustrates the relationship between the thickness H1 of the discharge orifice forming member 12, the height H2 of the inlet channel 24*a*, and the atmospheric communication time Tth. The horizontal axis represents the height H2 of the inlet channel 24*a*, and the vertical axis represents the thickness H1 of the discharge orifice forming member 12. The contour lines represent the Tth. The dimensions of standards A, B, and C in FIG. 25 are as follows.

Standard A: OH=12 μm, H1=7 μm, H2=5 μm, Tth≈1.4 μs

Standard B: OH=12 μm, H1=6 μm, H2=6 μm, Tth≈1.5 μs

Standard C: OH=12 μm, H1=5 μm, H2=7 μm, Tth≈1.6 μs

Accordingly, FIG. 25 illustrates the change in the atmospheric communication time Tth when the OH is fixed at 12 μm, and the height H2 of the inlet channel 24*a* (or the thickness H1 of the discharge orifice forming member 12) is changed. The Tth increases in the order of standards A, B, and C. Accordingly, in a case where the OH is constant, the atmospheric communication time Tth can be decreased more by a lower height H2 of the inlet channel 24*a*. The height H2 of the inlet channel 24*a* preferably is 7 μm or lower, and preferably is half or less the OH. The distance OH between the discharge orifice 13 and recording element 15 preferably is 12 μm or less.

Mechanism of Reducing Atmospheric Communication Time Tth

Next a mechanism of reducing the atmospheric communication time Tth will be described. FIGS. 26A through 27B illustrate the relationship between the distance OH and atmospheric communication position of the bubble. Directions dz and z are defined in FIG. 26A. This dz indicates the position in the z direction where the bubble communicates with the atmosphere with regard to the discharge orifice 13 as the origin, with the direction away from the recording element 15 being the positive direction. Accordingly, in a case where dz is positive, the atmospheric communication position is outside the discharge orifice portion 25 or outside of the discharge orifice 13, and in a case where dz is negative, the atmospheric communication position is inside the discharge orifice portion 25 or inside of the discharge orifice 13.

Figure 26A:
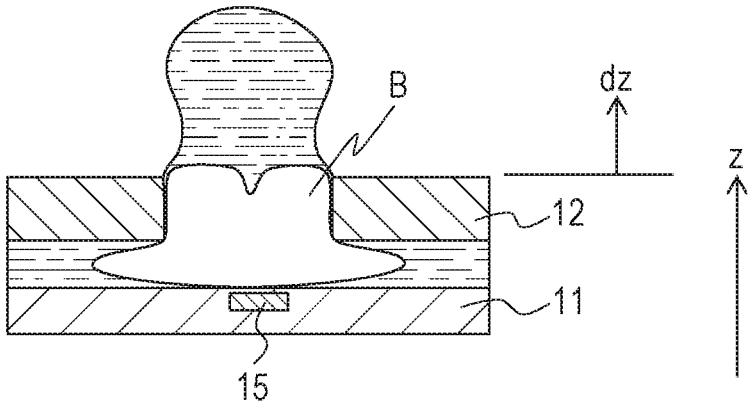
FIGS. 26A and 26B are diagrams illustrating the relationship between the distance from a recording element to a discharge orifice and an atmospheric communication location of the bubble.
Figure 26B:
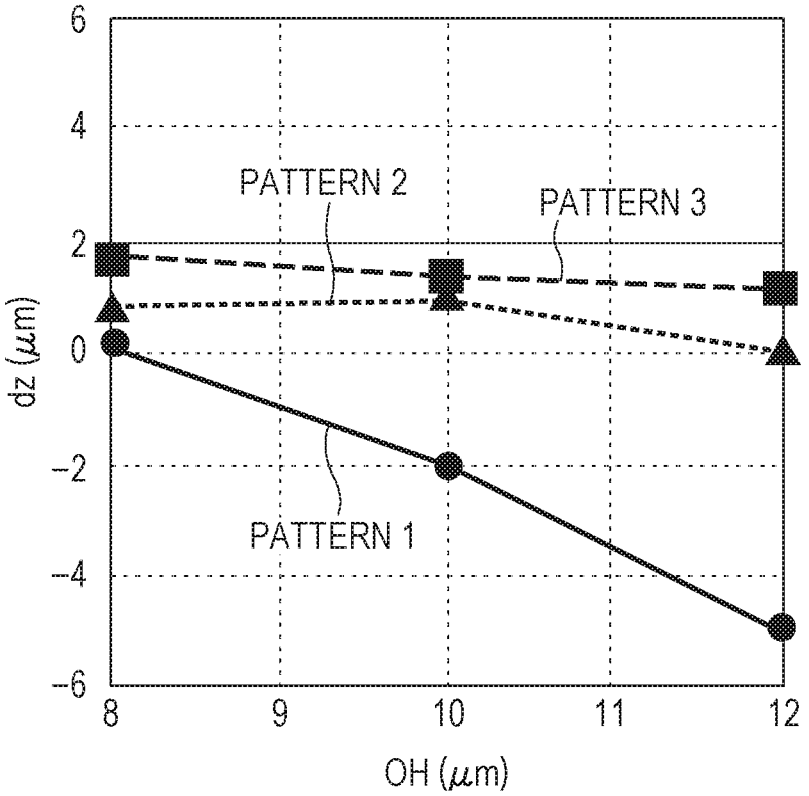

In FIG. 26B, the horizontal axis represents OH and the vertical axis represents dz. In a case where the shape of the discharge orifice 13 is circular (pattern 1), reducing the OH causes dz to asymptotically approach 0. That is to say, reducing the OH causes atmospheric communication to occur at a position near the discharge orifice 13. Consequently, Tth decreases, as can be seen from FIG. 23A. In a case where the discharge orifices 13 has the protrusions 27 (patterns 2 and 3), dz>0 when OH≤12 μm, with atmospheric communication occurring outside of the discharge orifices 13. This dz is greater in pattern 3 where the protrusion gap is narrower, and consequently Tth decreases accordingly.

Figure 27A:
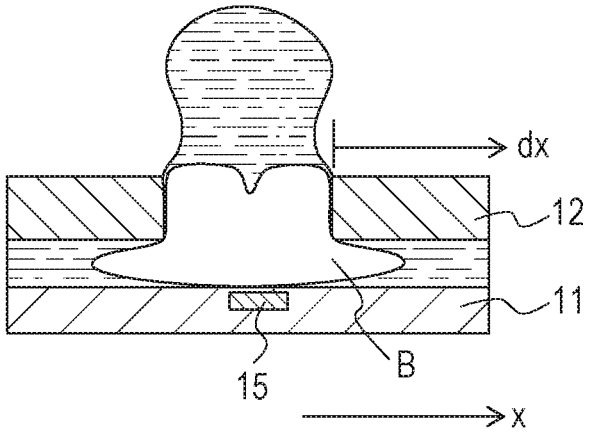
FIGS. 27A and 27B are diagrams illustrating the relationship between the distance from a recording element to a discharge orifice and an atmospheric communication location of the bubble.
Figure 27B:
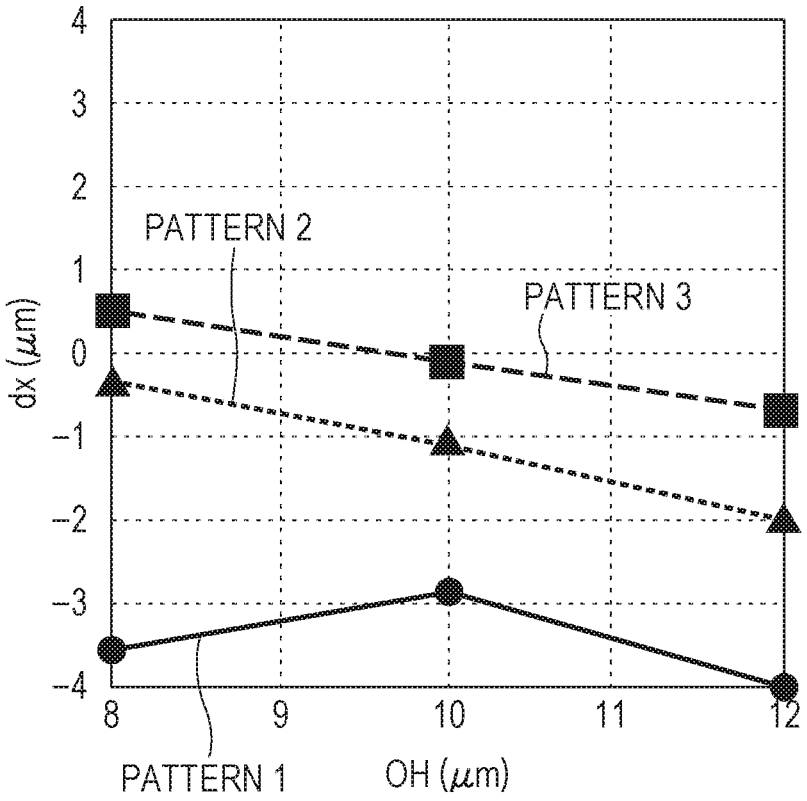

Directions dx and x are defined in FIG. 27A. This dx indicates the position in the x direction where the bubble communicates with the atmosphere with regard to the edge of the discharge orifice 13 as the origin, with the direction away from the center of the discharge orifice 13 being the positive direction. In FIG. 27B, the horizontal axis represents OH and the vertical axis represents dx. In a case where the shape of the discharge orifice 13 is circular (pattern 1), reducing the OH causes almost no change at all in dx. In a case where the discharge orifices 13 has the protrusions 27 (patterns 2 and 3), dx approaches 0, and dx increases as the OH is reduced. This dx is greater in pattern 3 where the protrusion gap is narrower.

Figure 28A:
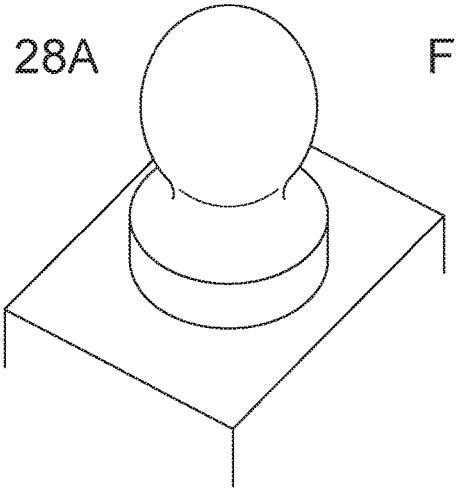
FIGS. 28A through 28F are conceptual diagrams illustrating droplets being discharged from discharge orifices.
Figure 28D:
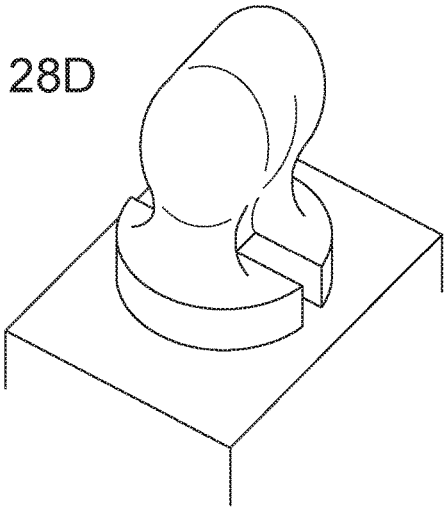
Figure 28B:
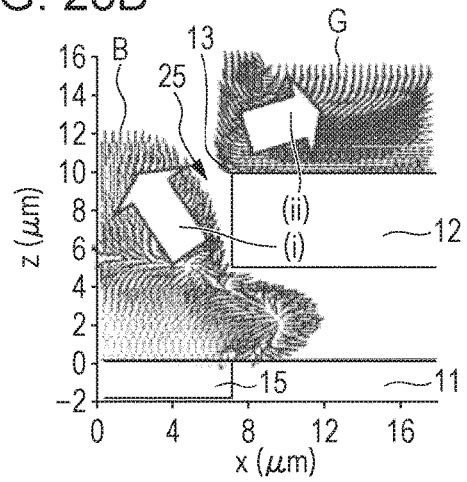
Figure 28E:
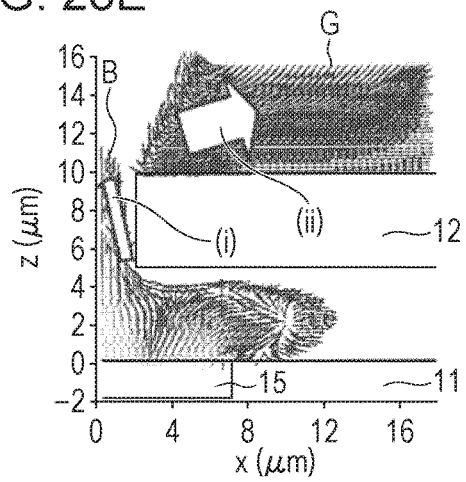
Figure 28C:
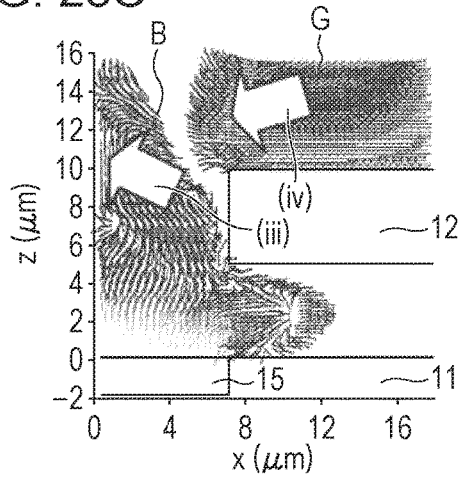
Figure 28F:
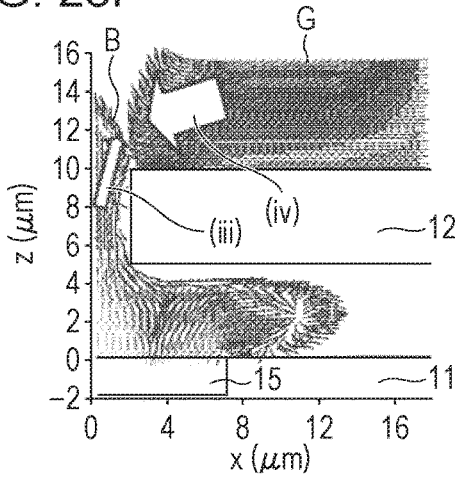

FIGS. 28A through 28F are drawings of a simulation illustrating droplets discharged from the discharge orifice 13, where FIG. 28A is a perspective view of a discharge droplet in a case where the discharge orifice 13 is circular in shape (pattern 1), and FIGS. 28B and 28C are diagrams illustrating transient change over time of the speed distribution of the bubble and the atmosphere. FIG. 28D is a perspective view of a discharge droplet in a case where the discharge orifice 13 has the protrusions 27, and FIGS. 28E and 28F are diagrams illustrating transient change over time of the speed distribution of the bubble and the atmosphere. FIGS. 28E and 28F are cross-sectional views taken along a line that passes through the two protrusions 27 provided to the discharge orifice 13 and the center of the discharge orifice 13 in FIG. 28D. The directions x and z are as defined in FIG. 27A. The transient phenomenon inside the discharge orifice portion 25 in a case where the shape of the discharge orifice 13 is a circle (pattern 1) is as follows, as illustrated in FIGS. 28B and 28C.

In stage 1, the generated bubble B enters the discharge orifice portion 25, and grows inside the discharge orifice portion 25. Accordingly, the bubble B has a speed component toward the center of the discharge orifices 13 (x=0) due to the effects of the discharge orifice forming member 12 wall (side wall of the discharge orifice portion 25) (see arrow (i) in FIG. 28B).

In stage 2, as the bubble grows, the atmosphere G outside of the discharge orifice 13 is temporarily pushed out in a direction away from the center of the discharge orifice 13, due to the discharged ink (see arrow (ii) in FIG. 28B).

In stage 3, the atmosphere G is drawn into the discharge orifice 13 due to the negative pressure inside the bubble B (see arrow (iv) in FIG. 28C).

In stage 4, the bubble B itself also is drawn toward the center of the discharge orifice portion 25 due to the negative pressure inside the bubble B, and further is drawn toward the center of the discharge orifice portion 25 due to the force of the interface of the ink (see arrow (iii) in FIG. 28C).

Consequently, the atmosphere G and the bubble B tend to communicate inside the discharge orifice portion 25. The bubble B does not readily communicate with the atmosphere G outside of the discharge orifice portion 25, and Tth tends to be long.

On the other hand, in a case of an arrangement where the discharge orifice 13 has the protrusions 27, the bubble B spreads toward the outside of the discharge orifice 13 due to the force of the interface of the ink (see arrow (iii) in FIG. 28F). At least part of the bubble B that has entered the discharge orifice portion 25 has a speed component toward the side walls from the center of the discharge orifice portion 25. Particularly, in a case where the curvature of the discharge orifice 13 is not constant due to having the protrusions 27, surface tension acts such that the air-liquid interface forms a sphere with a stable shape. The atmosphere G is drawn into the discharge orifice portion 25, while the bubble B spreads in a direction away from the center of the discharge orifice portion 25. Consequently, the atmosphere G and the bubble B have mutually opposite speed components, acting in directions colliding with each other, so atmospheric communication of the bubble B is facilitated. It can also be seen from FIG. 28F that the atmospheric communication position is outside of the discharge orifice portion 25 or discharge orifice 13.

Thus, by reducing the OH (distance between discharge orifice 13 and recording element 15 of 12 μm or less), and also providing the protrusions 27 to the discharge orifice 13 the following features Feature 1: shorter atmospheric communication time Tth Feature 2: communication of bubble G and atmosphere G outside of the discharge orifice portion 25

Feature 3: bubble B before communicating with atmosphere G spreads outward are obtained. Consequently, the tail is shorter, occurrence of satellites and mist is suppressed, and both high image quality and high throughput can be realized.

Figure 29:
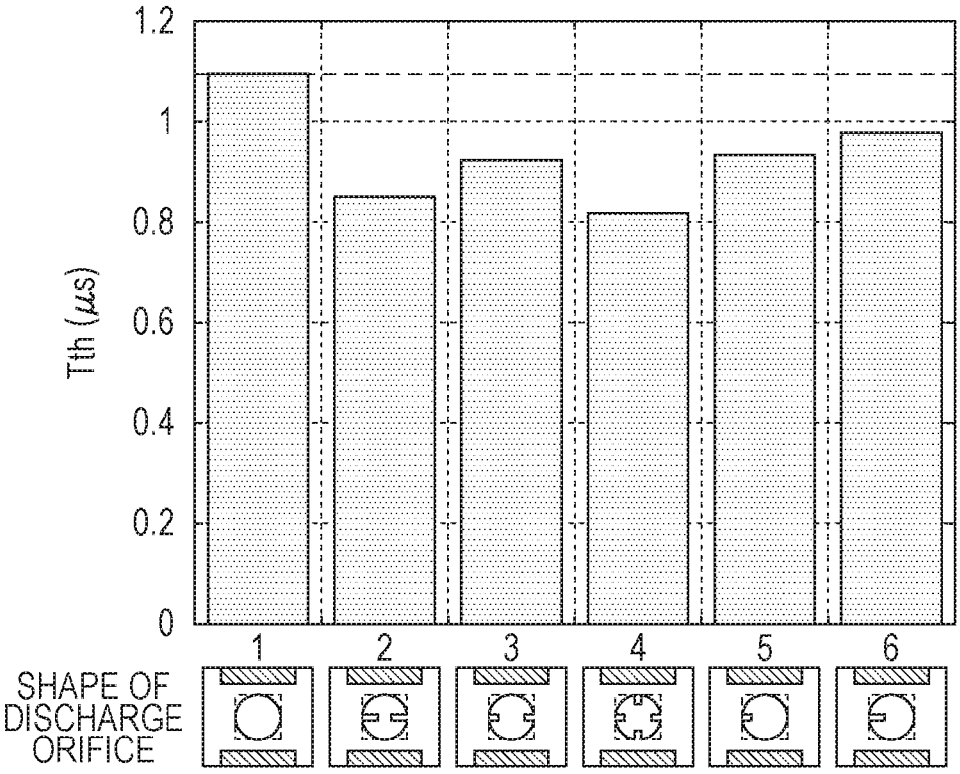
FIG. 29 is a diagram illustrating atmospheric communication times with regard to various discharge orifice shapes.
Figure 30:
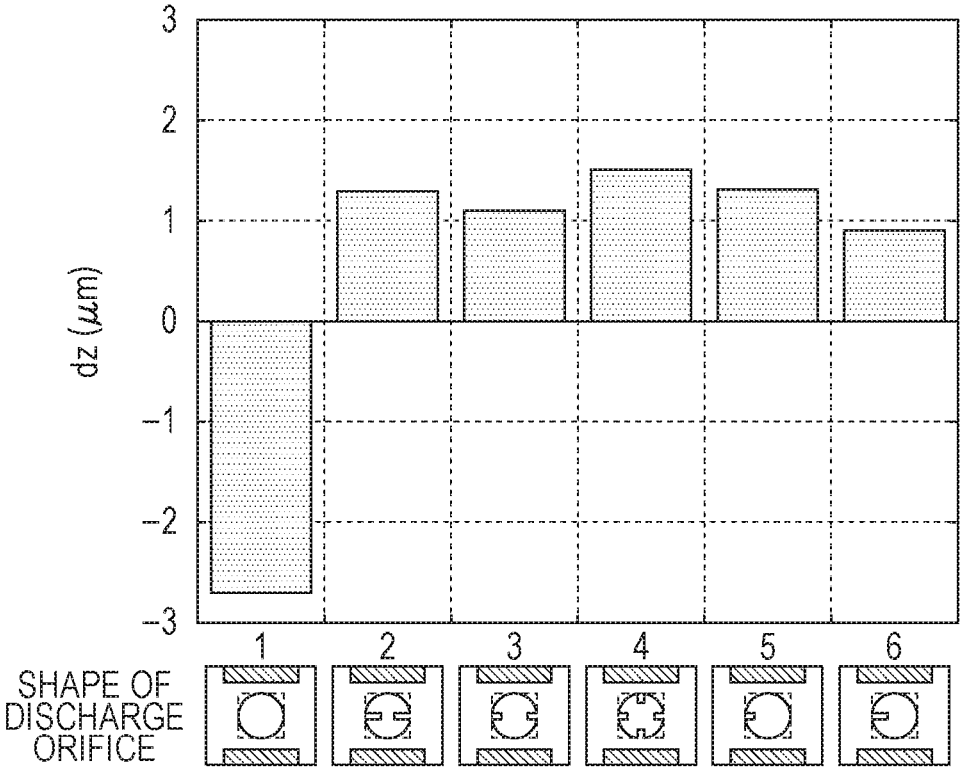
FIG. 30 is a diagram illustrating atmospheric communication locations with regard to various discharge orifice shapes.

FIGS. 29 and 30 are diagrams illustrating Tth and dz with regard to variously-shaped discharge orifices 13. Discharge orifice shapes 1 through 6 have the following features.

Discharge orifice shape 1: circular discharge orifice

Discharge orifice shape 2: discharge orifice having two symmetric protrusions 27, with wide gap between the protrusions 27

Discharge orifice shape 3: discharge orifice having two symmetric protrusions 27, with narrow gap between the protrusions 27

Discharge orifice shape 4: discharge orifice having four symmetric protrusions 27, with wide gap between the protrusions 27

Discharge orifice shape 5: discharge orifice having one protrusion 27, with wide gap between the protrusion 27 and opposing edge Discharge orifice shape 6: discharge orifice having one protrusion 27, with narrow gap between the protrusion 27 and opposing edge The discharge orifice shapes 2 through 6 each have at least one protrusion 27, with the protrusion(s) 27 being situated on a straight line passing through the center of the discharge orifice 13. All of the discharge orifice shapes 2 through 6 have a smaller Tth as compared to the discharge orifice shape 1. Further, all of the discharge orifice shapes 2 through 6 have a positive dz, meaning that the atmospheric communication is occurring outside of the discharge orifice portion 25. Accordingly, the discharge orifice shapes 2 through 6 are preferable embodiments, since they are capable of shortening the tail and suppressing satellites and mist. Note however, that in discharge orifice shape 4 where the number of protrusions 27 is increased, the flow resistance at the discharge orifice portion 25 increases, and discharge efficiency deteriorates. Accordingly, the number of protrusions 27 should not be too many. On the other hand, the discharge orifice shapes 5 and 6 have one protrusion 27 which is preferable from the perspective of flow resistance at the discharge orifice portion 25. However, the discharge orifice shape is asymmetric, so a situation occurs more readily where the ink droplet is ejected in a tilted state. From this perspective, the discharge orifice 13 is more preferably a symmetric shape. Accordingly, the most preferable embodiments are the discharge orifice shapes 2 and 3 having two protrusions 27 disposed symmetrically at both sides of the discharge orifice 13 across the center thereof. From the perspective of a shorter Tth, discharge orifice shape 3 is even more preferable, since it has two protrusions 27 disposed symmetrically on the discharge orifice 13, with a narrow gap between the protrusions 27.

Figure 31A:
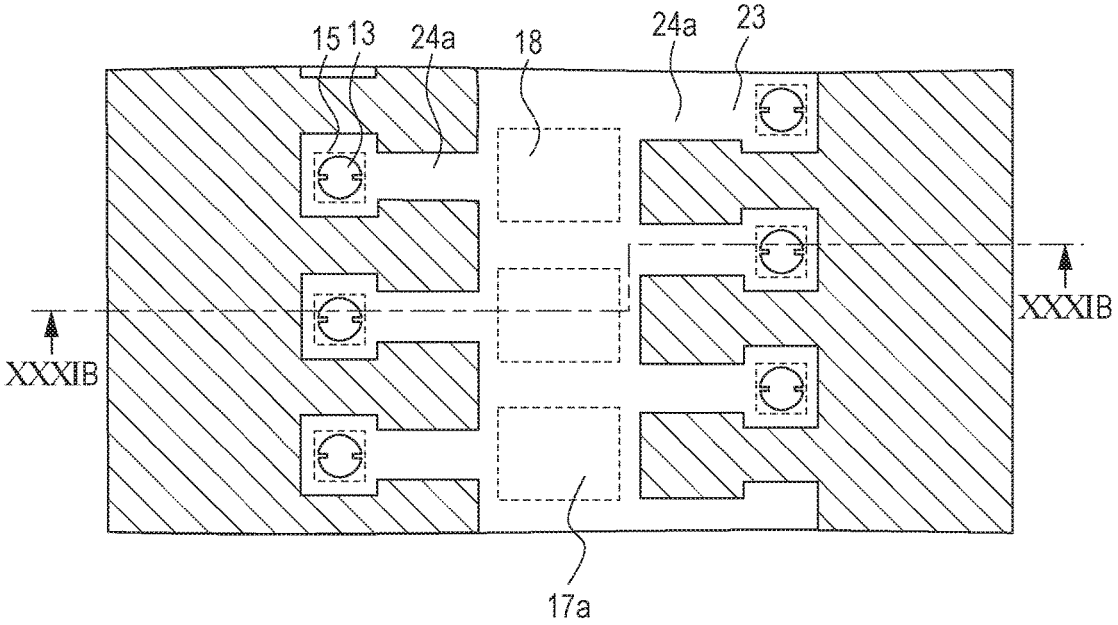
FIGS. 31A and 31B are conceptual diagrams illustrating inside of a liquid discharge head according to another embodiment.
Figure 31B:
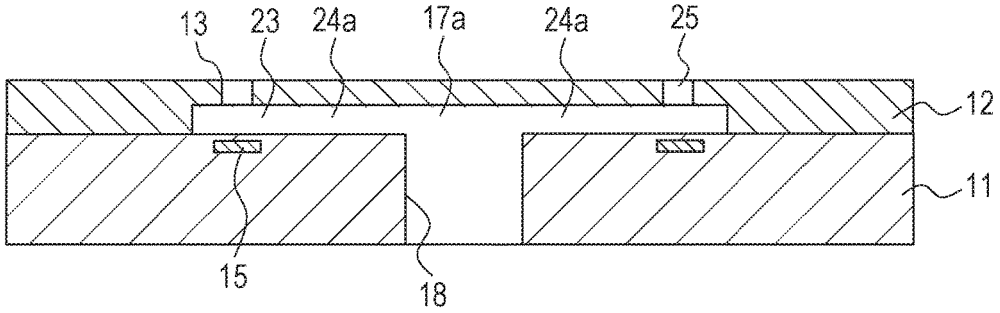

Although liquid channels are provided on both sides of the recording elements 15 as described in the embodiment above, the same effects can be obtained with a configuration where a liquid channel is provided only on one side of the recording element 15, as illustrated in FIGS. 31A and 31B.

Second Embodiment

Relationship between Channels and Circulation Direction

Figure 32A:
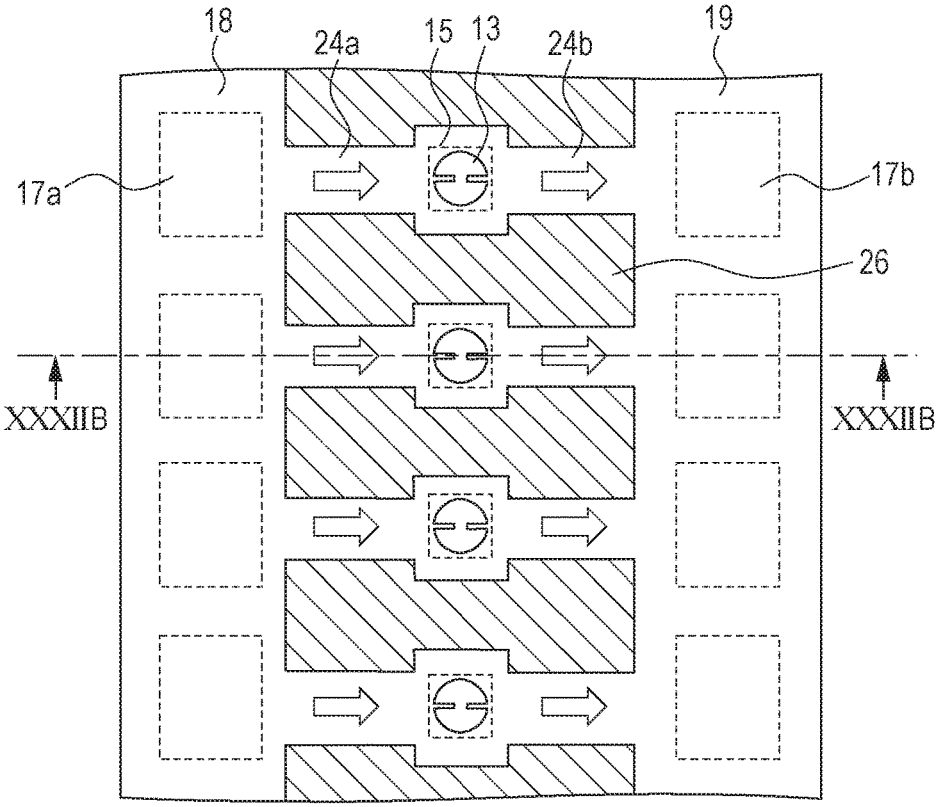
FIGS. 32A and 32B are conceptual diagrams illustrating inside of a liquid discharge head according to a second embodiment.
Figure 32B:
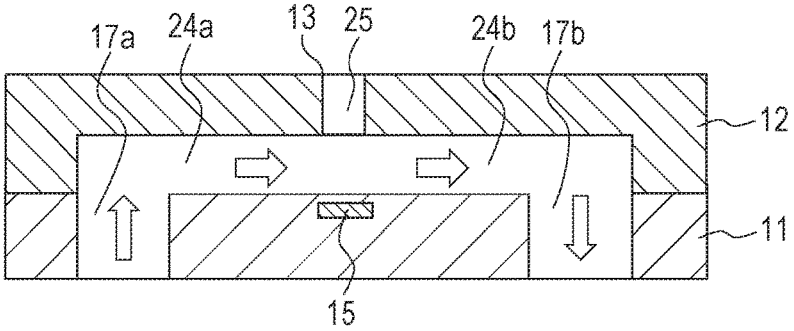

FIGS. 32A and 32B are diagrams illustrating a second embodiment of the present invention. FIG. 32A is a plan view illustrating recording elements 15 and channels, and FIG. 32B is a cross-sectional view taken along line XXXIIB-XXXIIB in FIG. 32A. The circulation flow is in a direction parallel to the protrusions 27 of the discharge orifices 13. This arrangement differs from the first embodiment illustrated in FIGS. 21A and 21B only with regard to the point that the recovery port row is provided only on one side of the supply port row, and all other points are the same. Accordingly, the first embodiment should be referenced for details.

Figure 33A:
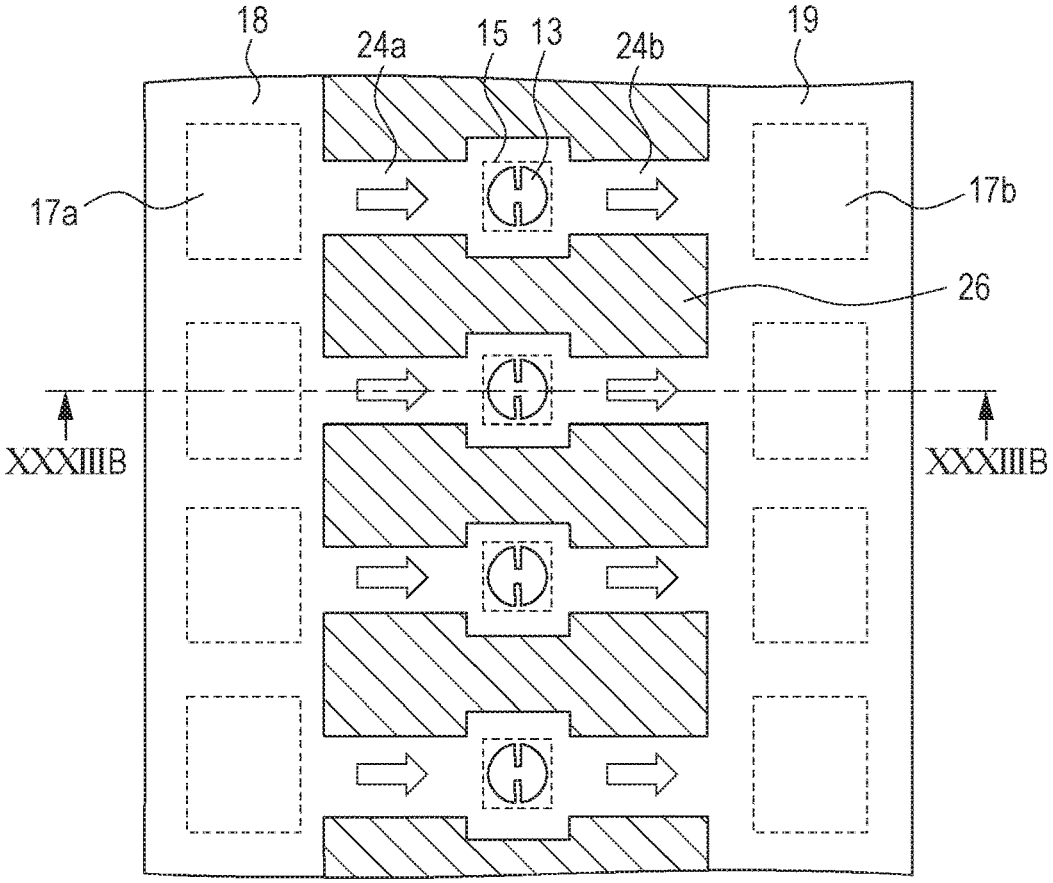
FIGS. 33A and 33B are conceptual diagrams illustrating inside of a liquid discharge head according to a reference example.
Figure 33B:
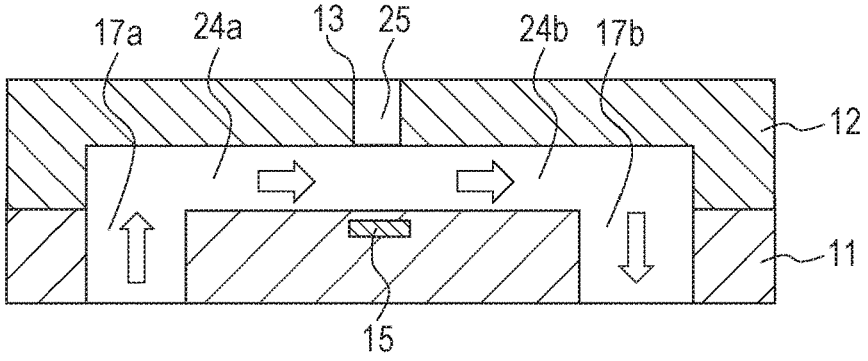
Figure 34A:
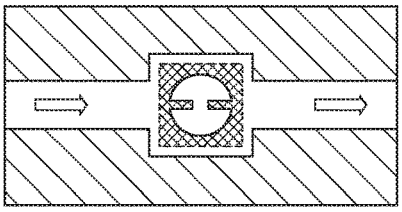
FIGS. 34A through 34H are conceptual diagrams illustrating discharge of droplets of the second embodiment and comparative example.
Figure 34B:
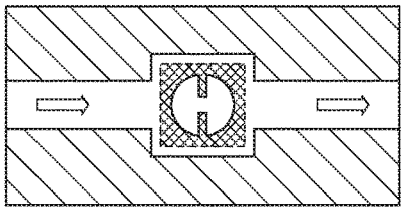
Figure 34C:
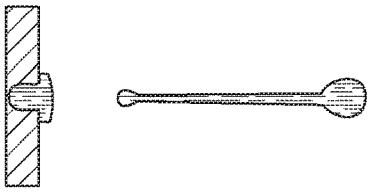
Figure 34D:
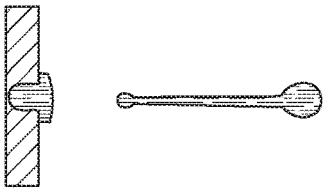
Figure 34E:
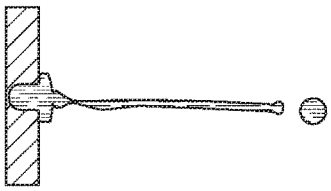
Figure 34F:
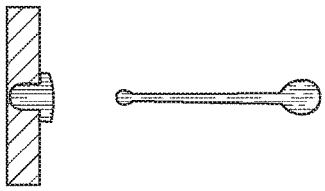

The arrangement illustrated in FIGS. 33A and 33B differs from the arrangement in FIGS. 32A and 32B with regard to the point that the protrusions 27 of the discharge orifices 13 extend in a direction orthogonal to the circulation flow. FIGS. 34A and 34B are diagrams focusing on one of the pressure chambers 23 in respective FIGS. 32A and 32B. In FIG. 34A, the circulation flow and the direction in which the protrusions 27 of the discharge orifice 13 extends is the same (substantially parallel), while the circulation flow and the direction in which the protrusions 27 of the discharge orifice 13 extends intersect in FIG. 34B (substantially orthogonal). FIGS. 34C and 34D illustrate numerical value calculation results regarding droplet formation in a case of continuous discharge, i.e., when effects of an intermission period is small regarding FIGS. 34A and 34B, respectively. FIGS. 34E and 34F illustrate numerical value calculation results regarding droplet formation after a predetermined intermission period, when effects of increased viscosity of ink due to evaporation of ink from the discharge orifices 13 are greater regarding FIGS. 34A and 34B, respectively.

Figure 34G:
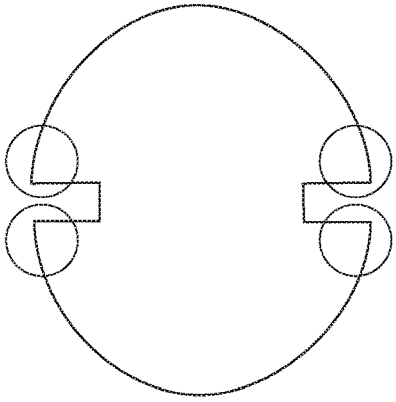
Figure 34H:
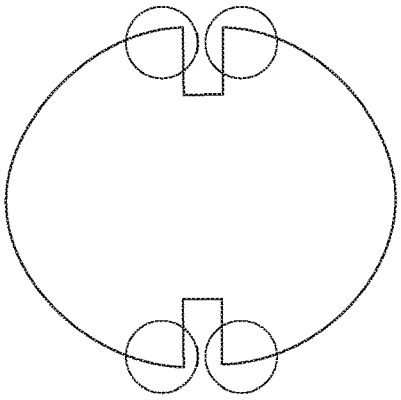

It can be seen from FIGS. 34E and 34F that the arrangement where the circulation flow is perpendicular to the protrusions 27 (FIG. 34B) is less readily affected by ink thickening, as compared to the configuration where the circulation flow is parallel to the protrusions 27 (FIG. 34A). It is thought that this is due to the rate of evaporation being greater at portions at the base of the protrusions 27 where the curvature radius is small (the portions encircled in FIGS. 34G and 34H), so an arrangement where the circulation flow flows through that region is less readily affected by concentration.

Accordingly, although the present embodiment can be applied to either of FIGS. 34E and 34F, but in order to further suppress concentration within the discharge orifice 13 in a configuration where there is a circulation flow, an arrangement where the circulation flow flows in a direction intersecting (more preferably, orthogonal to) the protrusions 27 of the discharge orifice 13 is more preferable. In other words, a line on which the protrusions 27 are situated preferably assumes an angle of 45 degrees or more as to a channel axis connecting the supply channel and recovery channel, and particularly preferably is orthogonal to the channel axis with regard to the point that concentration within the discharge orifice 13 can be suppressed.

There also are cases where the ejection direction of droplets that have been discharged deviates due to variation and deformation of the shapes of the protrusions 27. Taking this point into consideration, an arrangement is preferable where the direction of relative movement of the recording medium as to the liquid discharge head 3 and the direction in which the protrusions 27 extend agree (more preferably, are parallel). According to this configuration, even if the direction of ejection of droplets deviates due to deformation of the protrusions 27 or the like, effects on the recorded image will be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-002948 filed Jan. 8, 2016 and No. 2016-230099 filed Nov. 28, 2016, which are hereby incorporated by reference herein in their entirety.

What is claimed is:

1. A liquid discharge head comprising:

a recording element configured to generate thermal energy used to discharge liquid;

a pressure chamber having the recording element within;

a discharge orifice configured to discharge liquid, and include at least one protrusion extending toward a center of the discharge orifice; and a discharge orifice portion communicating between the discharge orifice and the pressure chamber, wherein a bubble is generated in the pressure chamber by the thermal energy, the generated bubble enters into the discharge orifice portion, and liquid is discharged from the discharge orifice, in a direction downstream of the discharge orifice, by the pressure of the bubble, and wherein the bubble first communicates with the atmosphere at a location downstream of the discharge orifice.

2. The liquid discharge head according to claim 1, wherein a distance between the discharge orifice and the recording element is 12 μm or less.

3. The liquid discharge head according to claim 1, wherein the liquid discharge head includes a liquid supply channel communicating with the pressure chamber and configured to supply liquid to the pressure chamber, the height of the liquid supply channel in a direction perpendicular to the bottom face of the pressure chamber being 7 μm or less.

4. The liquid discharge head according to claim 1, wherein the opening area of the discharge orifice is 100 $\mu m^2$ or more.

5. The liquid discharge head according to claim 1, wherein the liquid discharge head includes a liquid supply channel communicating with the pressure chamber and configured to supply liquid to the pressure chamber, the height of the liquid supply channel in a direction perpendicular to the bottom face of the pressure chamber being half or less the distance between the discharge orifice and the recording element.

6. The liquid discharge head according to claim 1, wherein the at least one protrusion includes two protrusions extending facing each other.

7. The liquid discharge head according to claim 1, wherein the liquid discharge head includes a liquid supply channel communicating with the pressure chamber and configured to supply liquid to the pressure chamber, and a liquid recovery channel communicating with the pressure chamber on the opposite side of the pressure chamber from the liquid supply channel and configured to recover the liquid.

8. The liquid discharge head according to claim 7, wherein the at least one protrusion includes two protrusions extending facing each other, the two protrusions being situated on a straight line passing through a center of the discharge orifice and disposed on both sides across from the center, the straight line assuming an angle of 45 degrees or more as to a channel axis connecting the liquid supply channel and the liquid recovery channel.

9. The liquid discharge head according to claim 8, wherein the straight line and the channel axis intersect each other.

10. The liquid discharge head according to claim 1, wherein the liquid within the pressure chamber is circulated between the inside of the pressure chamber and the outside of the pressure chamber.

11. The liquid discharge head according to claim 1, wherein, along an axis perpendicular to the recording element and parallel to the downstream direction, the location at which the bubble first communicates with the atmosphere is a distance, from the recording element, greater than the distance of the discharge orifice from the recording element.

12. A liquid discharge head comprising:

a recording element configured to generate thermal energy used to discharge liquid;

a pressure chamber having the recording element within;

a discharge orifice configured to discharge liquid, and include at least one protrusion extending toward a center of the discharge orifice; and a discharge orifice portion communicating between the discharge orifice and the pressure chamber, wherein a bubble is generated in the pressure chamber by the thermal energy, the bubble enters the discharge orifice portion, and liquid is discharged, in a downstream direction, from the discharge orifice by the pressure of the bubble, and wherein at least part of the bubble that has entered into the discharge orifice portion has a speed component from a center of the discharge orifice portion toward a side wall of the discharge orifice, at a time of first communication between the atmosphere and the bubble.

13. The liquid discharge head according to claim 12, wherein the bubble that has entered into the discharge orifice portion communicates with the atmosphere on the outside of the discharge orifice.

14. The liquid discharge head according to claim 12, wherein, at the time of first communication between the atmosphere and the bubble, the atmosphere and the bubble have mutually opposite speed components, acting in directions colliding with each other.

15. The liquid discharge head according to claim 12, wherein the liquid within the pressure chamber is circulated between the inside of the pressure chamber and the outside of the pressure chamber.

16. A liquid discharge head comprising:

a recording element configured to generate thermal energy used to discharge liquid;

a pressure chamber having the recording element within;

a liquid supply channel communicating with the pressure chamber and configured to supply liquid to the pressure chamber; and a discharge orifice configured to discharge liquid, wherein the discharge orifice has at least two protrusions protruding toward a middle of the discharge orifice, wherein a height of the liquid supply channel is 7 μm or less, wherein a bubble is generated in the pressure chamber by the thermal energy, the generated bubble enters into the discharge orifice portion, and liquid is discharged from the discharge orifice, in a direction downstream of the discharge orifice, by the pressure of the bubble, and wherein the bubble first communicates with the atmosphere at a location downstream of the discharge orifice.

17. The liquid discharge head according to claim 16, wherein a distance between the discharge orifice and the recording element is 12 μm or less.

18. The liquid discharge head according to claim 16, wherein the liquid within the pressure chamber is circulated between the inside of the pressure chamber and the outside of the pressure chamber.

19. A liquid discharge method of a liquid discharge head including a recording element configured to generate thermal energy used to discharge liquid, a pressure chamber having the recording element within, a discharge orifice configured to discharge liquid, and include at least one protrusion extending toward a center of the discharge orifice, and a discharge orifice portion communicating between the discharge orifice and the pressure chamber, the method comprising:

generating a bubble in the liquid by the recording element configured to generate thermal energy used to discharge the liquid;

causing the generated bubble to enter into the discharge orifice portion; and discharging the liquid from the discharge orifice, in a downstream direction of the discharge orifice, by the pressure of the generated bubble, wherein at least part of the bubble that has entered into the discharge orifice portion has a speed component from a center of the discharge orifice portion toward a side wall of the discharge orifice, at a time of first communication between the atmosphere and the bubble.

20. A liquid discharge method of a liquid discharge head including a recording element configured to generate thermal energy used to discharge liquid, a pressure chamber having the recording element within, a discharge orifice configured to discharge liquid, and include at least one protrusion extending toward a center of the discharge orifice, and a discharge orifice portion communicating between the discharge orifice and the pressure chamber, the method comprising:

generating a bubble in the liquid by the recording element configured to generate thermal energy used to discharge the liquid;

causing the generated bubble to enter into the discharge orifice portion; and discharging liquid within the discharge orifice portion from the discharge orifice, in a direction downstream of the discharge orifice, by the pressure of the generated bubble, wherein the bubble first communicates with the atmosphere at a location downstream of the discharge orifice.

* * * * *